US005334329A

United States Patent [19]

Vinci et al.

[11] Patent Number: 5,334,329

[45] Date of Patent: Aug. 2, 1994

[54] LUBRICANT AND FUNCTIONAL FLUID COMPOSITIONS EXHIBITING IMPROVED DEMULSIBILITY

[75] Inventors: James N. Vinci, Mayfield Hts.; James J. Schwind, Eastlake, both of Ohio

[73] Assignee: The Lubrizol Corporation, Wickliffe, Ohio

[21] Appl. No.: 255,890

[22] Filed: Oct. 7, 1988

[51] Int. Cl.[5] ..... C10M 133/44

[52] U.S. Cl. ..... 252/49.6; 252/50; 252/51.5 R

[58] Field of Search ..... 252/51.5 R, 49.6, 50

[56] References Cited

U.S. PATENT DOCUMENTS

| | | | |
|---|---|---|---|
| 1,815,022 | 7/1931 | Davis | 252/52 R |
| 2,015,748 | 10/1935 | Fralich | 260/168 |
| 2,191,498 | 2/1940 | Reiff | 87/9 |
| 2,214,152 | 9/1940 | Wilkes | 252/50 |
| 2,267,965 | 12/1941 | Wilson | 260/309 |
| 2,329,619 | 9/1943 | Jayne et al. | 260/244 |
| 2,387,501 | 10/1945 | Dietrich | 252/47.5 |
| 2,655,479 | 10/1953 | Munday et al. | 252/56 |
| 2,666,746 | 1/1954 | Munday et al. | 252/56 |
| 2,721,877 | 10/1955 | Popkin et al. | 260/485 |
| 2,721,878 | 10/1955 | Popkin | 260/485 |
| 2,905,644 | 9/1959 | Butter | 252/392 |
| 3,036,003 | 5/1962 | Verdol | 252/33.4 |
| 3,087,936 | 4/1963 | LeSuer | 260/326.3 |
| 3,172,892 | 3/1965 | LeSuer et al. | 260/326.5 |
| 3,200,107 | 8/1965 | LeSuer | 260/132 |
| 3,215,707 | 11/1965 | Rense | 260/326.3 |
| 3,219,666 | 11/1965 | Norman et al. | 260/268 |
| 3,231,587 | 1/1966 | Rense | 260/346.8 |
| 3,250,715 | 5/1966 | Wyman | 252/56 |
| 3,254,025 | 5/1966 | LeSuer | 252/32.7 |
| 3,256,185 | 6/1966 | LeSuer | 252/32.7 |
| 3,272,746 | 9/1966 | LeSuer et al. | 252/47.5 |
| 3,275,554 | 9/1966 | Wagenaar | 252/50 |
| 3,278,550 | 10/1966 | Norman et al. | 260/326.3 |
| 3,281,428 | 10/1966 | LeSuer | 260/326.3 |
| 3,282,955 | 11/1966 | LeSuer | 260/326.3 |
| 3,284,410 | 11/1966 | Meinhardt | 252/49.6 |
| 3,316,177 | 4/1967 | Dorer | 252/51.5 |
| 3,329,658 | 7/1967 | Fields | 260/78.5 |

(List continued on next page.)

FOREIGN PATENT DOCUMENTS

| | | |
|---|---|---|
| 653881 | 10/1984 | Belgium . |
| 00074724 | 3/1983 | European Pat. Off. . |
| 2281422 | 3/1976 | France . |
| WO87/05926 | 10/1987 | PCT Int'l Appl. . |
| WO87/06228 | 10/1987 | PCT Int'l Appl. . |

(List continued on next page.)

OTHER PUBLICATIONS

R. H. Wiley and L. L. Bennett, Jr., in Chem Reviews, Jun. 1949, vol. 44, pp. 447–476.

"Lubricant Additives", by C. V. Smalheer and R. Kennedy Smith (Lezius-Hiles Co. publishers, Cleveland, Ohio 1967), p. 8.

*Primary Examiner*—Ellen M. McAvoy

*Attorney, Agent, or Firm*—Joseph P. Fischer; Frederick D. Hunter, Sr.; James L. Cordek

[57] ABSTRACT

A lubricating composition is described which comprises a mixture of (A) a major amount of an oil of lubricating viscosity, (B) a dispersant effective amount of at least one ashless dispersant, and (C) a minor, effective amount of at least one demulsifier characterized by the formula

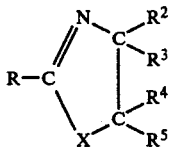

wherein R is a hydrocarbyl group, $R^2$, $R^3$, $R^4$ and $R^5$ are each independently H or hydrocarbyl groups, and X is O or NR' wherein R' is hydrogen or a hydrocarbyl group.

In one embodiment, the ashless dispersant is a carboxylic dispersant, and the demulsifier is a derivative of imidazoline. The lubricating compositions of the invention are characterized as having improved dispersancy, demulsibility, rust-inhibition and anti-wear properties.

48 Claims, No Drawings

FOREIGN PATENT DOCUMENTS

| | | | |
|---|---|---|---|
| 1085903 | 10/1967 | United Kingdom . | |
| 1162436 | 8/1969 | United Kingdom . | |
| 1440219 | 6/1976 | United Kingdom . | |
| 2055804A | 3/1981 | United Kingdom . | |

U.S. PATENT DOCUMENTS

| | | | |
|---|---|---|---|
| 3,338,832 | 8/1967 | LeSuer | 252/47.5 |
| 3,341,542 | 9/1967 | LeSuer et al. | 260/268 |
| 3,366,569 | 1/1968 | Norman et al. | 252/51.5 |
| 3,373,111 | 3/1968 | LeSuer et al. | 252/51.5 |
| 3,413,347 | 11/1968 | Worrel | 260/570.5 |
| 3,415,750 | 12/1968 | Anzenberger | 252/51.5 A |
| 3,438,757 | 4/1969 | Honnen et al. | 44/58 |
| 3,442,808 | 5/1969 | Traise et al. | 252/49.6 |
| 3,444,170 | 5/1969 | Norman et al. | 260/268 |
| 3,449,250 | 6/1969 | Fields | 252/51.5 |
| 3,454,555 | 7/1969 | vander Voort et al. | 260/239 |
| 3,454,607 | 7/1969 | LeSuer et al. | 260/408 |
| 3,455,832 | 7/1969 | Davis | 252/51.5 |
| 3,493,520 | 2/1970 | Verdol et al. | 252/51.5 |
| 3,513,093 | 5/1970 | LeSuer | 252/32.5 |
| 3,519,565 | 7/1970 | Coleman | 252/47.5 |
| 3,522,179 | 7/1970 | LeSuer | 252/51.5 |
| 3,533,945 | 10/1970 | Vogel | 252/49.6 |
| 3,539,633 | 11/1970 | Piasek et al. | 260/570.5 |
| 3,541,012 | 11/1970 | Stuebe | 252/51.5 |
| 3,565,804 | 2/1971 | Honnen et al. | 252/50 |
| 3,579,450 | 5/1971 | LeSuer | 252/56 |
| 3,600,372 | 8/1971 | Udelhofen | 260/132 |
| 3,630.904 | 12/1971 | Musser et al. | 252/51.5 A |
| 3,632,511 | 1/1972 | Liao | 252/51.5 A |
| 3,639,242 | 2/1972 | LsSuer | 252/56 R |
| 3,649,659 | 3/1972 | Otto et al. | 260/429 R |
| 3,666,730 | 5/1972 | Coleman | 260/78.5 B |
| 3,687,849 | 8/1972 | Abbott | 252/47.5 |
| 3,697,574 | 10/1972 | Piasek et al | 260/462 R |
| 3,702,300 | 11/1972 | Coleman | 252/51.5 A |
| 3,703,536 | 11/1972 | Piasek et al. | 260/462 R |
| 3,708,522 | 1/1973 | LeSuer | 260/485 G |
| 3,725,277 | 4/1973 | Worrel | 252/51.5 R |
| 3,725,480 | 4/1973 | Traise et al. | 260/583 P |
| 3,726,882 | 4/1973 | Traise et al. | 260/296 |
| 3,787,374 | 1/1974 | Adams | 260/78.4 D |
| 3,859,318 | 1/1975 | LeSuer | 260/410.6 |
| 3,865,813 | 2/1975 | Gugel | 260/239.3 R |
| 3,912,764 | 10/1975 | Palmer, Jr. | 260/346.8 |
| 3,957,854 | 5/1976 | Miller | 260/482 R |
| 4,097,389 | 6/1978 | Andress, Jr. | 252/51.5 A |
| 4,110,349 | 8/1978 | Cohen | 260/346.74 |
| 4,119,549 | 10/1978 | Davis | 252/45 |
| 4,129,508 | 12/1978 | Frühauf | 252/33 |
| 4,234,435 | 11/1980 | Meinhardt et al. | 252/51.5 A |
| 4,256,592 | 3/1981 | Gemmill et al. | 252/46.7 |
| 4,273,665 | 6/1981 | Braid et al. | 252/49.6 |
| 4,298,486 | 11/1981 | Horodysky et al. | 252/49.6 |
| 4,406,802 | 9/1983 | Horodysky et al. | 252/49.6 |

LUBRICANT AND FUNCTIONAL FLUID COMPOSITIONS EXHIBITING IMPROVED DEMULSIBILITY

FIELD OF THE INVENTION

This invention relates to lubricating and functional fluid compositions, and to additive concentrates useful in preparing such compositions. More particularly, the lubricating compositions of the present invention comprise an oil of lubricating viscosity, an ashless dispersant, and a minor effective amount of a demulsifier. The compositions are useful in automotive as well as industrial applications.

BACKGROUND OF THE INVENTION

The problems associated with the lubrication of gears such as utilized in automotive transmissions and axles are well known to those skilled in the art. In the lubrication of automatic transmissions, proper fluid viscosity at both low and high temperatures is essential to successful operation. Good low temperature fluidity eases cold weather starting and insures that the hydraulic control system will properly "shift gears". High viscosity at elevated temperatures insures pumpability and the satisfactory operation of converters, valves, clutches, gears and bearings.

It also is well known that the high pressure which occurs in certain types of gears and bearings may cause rupture of lubricant films with consequent damage to the machinery. Because of the severe conditions under which they are used, industrial and automotive gear lubricants ordinarily must contain additives which maximize their capability of functioning under extreme pressure conditions. It has been suggested that certain compounds of metal-reactive elements, such as compounds of chlorine, sulfur, phosphorus and lead impart extreme pressure properties to various lubricants. Among the various compositions known to serve this purpose are various phosphorus- and sulfur-containing compositions, chiefly salts and esters of dialkylphosphorodithioic acids, and sulfurization products of various aliphatic olefinic compounds. These two types of compositions have been used in combination in lubricants of this type, and they serve to increase the effectiveness of the lubricant under conditions of extreme pressure.

In addition to extreme pressure agents, lubricating compositions useful as gear lubricants generally will contain one or more of the following: dispersants, detergents, pour point depressants, oxidation inhibitors, corrosion inhibitors, foam inhibitors, friction modifiers and viscosity improvers.

Lubricating and industrial oil compositions contain dispersants which are capable of dispersing sludge and other deposits formed in the oil compositions in use. Unless maintained in fine suspension (i.e., dispersed in the lubricating or industrial oil) the sludge deposits on gears, bearings and seals where it eventually interferes with equipment operation. Dispersants which have been used extensively in lubricants and functional fluids include the so-called ashless dispersants. These dispersants are referred to as being ashless because they do not ordinarily contain metal and therefore do not yield a metal-containing ash on combustion. Many types of ashless dispersants are known in the art, and they are described more fully below.

It is well known that water is an undesirable contaminant in lubricants and functional fluids. Water not only reduces the effectiveness of the lubricant or fluid, it tends to form deleterious by-products, particularly in relation to the metal parts in contact with or utilizing the lubricant or functional fluid. For example, water present in a lubricant is responsible for the formation of objectionable mayonnaise-like sludge which in turn promotes the formation of hard-to-remove deposits from various parts of the machinery being lubricated. Presumably, the formation of the sludge is preceded by the water forming an emulsion with the lubricant oil. While water should be separable from an oil or functional fluid due to immiscibility, some of the additives in the lubricants or functional fluids may have water-solubility sufficient to form emulsions which are difficult to remove. Also, the presence of additives such as ashless dispersants and detergents facilitate the formation and increase the stability of emulsions thereby making it difficult to separate the water from the oil or functional fluid. Therefore, it is important to minimize the presence of water in lubricating compositions and functional fluids to reduce or eliminate the formation of such emulsions.

Obviously, lubricants having minimum contact with water will not present serious problems of water-oil emulsions. However, it is difficult to eliminate contact with water, particularly during storage, handling, and/or use (e.g., in a steel mill environment).

Demulsifiers have been suggested and used in the prior art. Primarily, these demulsifiers have comprised compositions such as polyoxyalkylene glycols and polyoxypolyamines. It has been observed, however, that these glycols and polyamines have not been entirely satisfactory because of their limited use and inability to function except in specific lubricants or functional fluids.

U.S. Pat. No. 4,129,508 describes a demulsifier additive composition for lubricants and fuels which comprises (A) one or more reaction products of a hydrocarbon-substituted succinic acid or anhydride with one or more polyalkylene glycols or monoethers thereof, (B) one or more organic basic metal salts, and (C) one or more alkoxylated amines.

The use of various derivatives of imidazolines as friction-reducing additives in lubricating compositions is described in U.S. Pat. Nos. 4,406,802; 4,298,486; and 4,273,665. The '802 patent describes the use of mixed borated alcohol-amines, alcohol-amides, alcohol-ethoxylated amines, alcohol-ethoxylated amides, alcohol-hydroxy esters, alcohol-imidazolines and alcohol-hydrolyzed imidazolines and mixtures thereof as friction-modifying agents in various organic media. The borated derivatives include those derived from hydroxy alkyl or hydroxy alkenyl alkyl or alkenyl imidazolines and/or the hydrolysis products of the imidazolines. The '486 patent describes boric acid salts and borate esters of hydroxyethyl alkyl imidazolines whereas U.S. Pat. No. 4,273,665 describes the use of hydrolysis products of 1-(2-hydroxyalkyl)-2-alkyl or alkenyl imidazolines and borated adducts of hydrolyzed 1-(2-hydroxyethyl)-2-alkyl imidazolines as friction modifiers for lubricating oils. In addition to exhibiting friction-reducing properties, the imidazoline derivatives described in the above patents are reported to provide the lubricant with copper anticorrosion and antioxidant properties.

SUMMARY OF THE INVENTION

A lubricating composition is described which comprises a mixture of (A) a major amount of an oil of lubricating viscosity, (B) a dispersant effective amount of at least one ashless dispersant, and (C) a minor, effective amount of at least one demulsifier characterized by the formula

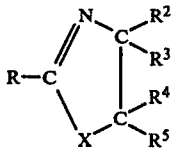

wherein R is a hydrocarbyl group, $R^2$, $R^3$, $R^4$ and $R^5$ are each independently H or hydrocarbyl groups, and X is O or NR′ wherein R′ is hydrogen or a hydrocarbyl group.

In one embodiment, the ashless dispersant is a carboxylic dispersant, and the demulsifier is a derivative of imidazoline. The lubricating compositions of the invention are characterized as having improved dispersancy, demulsibility, rust-inhibition and anti-wear properties.

DESCRIPTION OF THE PREFERRED EMBODIMENTS

Throughout the specification and claims, references to percentages by weight of the various components, except for component (A) which is oil, or on a chemical basis unless otherwise indicated. For example, when the oil compositions of the invention are described as containing 1% by weight of (B), the oil composition comprises 1% by weight of (B) on a chemical basis. Thus, if component (B) is available as a 50% by weight oil solution, 2% by weight of the oil solution would be included in the oil composition of the invention.

As used in this specification and in the appended claims, the term "hydrocarbyl" denotes a group having a carbon atom directly attached to the remainder of the molecule and having a hydrocarbon or predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc.

(2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy, nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms. Suitable hereto atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl-based", "aryl-based", and the like have meanings analogous to the above with respect to alkyl groups, aryl groups and the like.

The term "hydrocarbon-based" has the same meaning and can be used interchangeably with the term hydrocarbyl when referring to molecular groups having a carbon atom attached directly to the remainder of a molecule.

The term "lower" as used herein in conjunction with terms such as hydrocarbyl, alkyl, alkenyl, alkoxy, and the like, is intended to describe such groups which contain a total of up to 7 carbon atoms.

The term "oil-soluble" refers to a material that is soluble in mineral oil or the lubricating oil or functional fluid compositions of this invention to the extent of at least about one gram per liter at 25° C.

Throughout the specification and claims, unless otherwise specifically stated, all parts and percentages are by weight, temperatures are in degrees centigrade, and pressures are atmospheric,

(A) Oil of Lubricating Viscosity

The oil which is utilized in the preparation of the lubricants of the invention may be based on natural oils, synthetic oils, or mixtures thereof.

Natural oils include animal oils and vegetable oils (e.g., castor oil, lard oil) as well as mineral lubricating oils such as liquid petroleum oils and solvent treated or acid treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$ Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methylhexyl)silicate, tetra-(p-tert-butylphenyl)silicate, hexyl-(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the concentrates of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, hydrotreating, secondary distillation, acid or base extraction, filtration, percolation, etc. Rerefined oils are obtained by processes similar to those used to obtain refined oils applied to refined oils which have been already used in service. Such rerefined oils are also known as reclaimed, recycled or reprocessed oils and often are additionally processed by techniques directed to removal of spent additives and oil breakdown products.

(B) Ashless Dispersant

The lubricating compositions of the present invention contain a dispersant effective amount of at least one ashless dispersant. Ashless dispersants are referred to as being ashless despite the fact that, depending on their constitution the dispersants may upon combustion yield a non-volatile material such as boric oxide or phosphorus pentoxide. However, the ashless dispersants do not ordinarily contain metal, and therefore do not yield a metal-containing ash upon combustion. Many types of ashless dispersants are known in the prior art, and any of these is suitable for use in the lubricating compositions of the present invention. The ashless dispersants which can be utilized in the lubricating compositions of the present invention include the following: carboxylic dispersants; amine dispersants; Mannich dispersants; polymeric dispersants; and carboxylic, amine or Mannich dispersants post-treated with such reagents as urea, thiourea, carbon disulfide, aldehydes, ketones, carboxylic acids, hydrocarbon-substituted succinic anhydrides, nitriles, epoxides, boron compounds, phosphorus compounds, etc.

The amine dispersants are reaction products of relatively high molecular weight aliphatic or alicyclic halides with amines, preferably polyalkylene polyamines. Amine dispersants are known and have been described in the prior art such as in U.S. Pat. Nos. 3,275,554; 3,438,757; 3,454,555; and 3,565,804. Mannich dispersants are reaction products of alkyl phenols in which the alkyl group contains at least about 30 carbon atoms with aldehydes (especially formaldehyde) and amines (especially polyalkylene polyamines). The materials described in the following patents are illustrative of Mannich dispersants: U.S. Pat. Nos. 3,413,347; 3,697,574; 3,725,277; 3,725,480; and 3,726,882.

Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like are useful ashless dispersants. Exemplary materials of this kind are described in the following U.S. Pat. Nos. 3,036,003; 3,200,107; 3,254,025; 3,278,550; 3,281,428; 3,282,955; 3,366,569; 3,373,111; 3,442,808; 3,455,832; 3,493,520; 3,513,093; 3,539,633; 3,579,450; 3,600,372; 3,639,242; 3,649,659; 3,703,536; and 3,708,522. Polymeric dispersants are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Polymeric dispersants are disclosed in the following U.S. Pat. Nos. 3,329,658; 3,449,250; 3,519,565; 3,666,730; 3,687,849; and 3,702,300. All of the above-noted patents are incorporated by reference herein for their disclosures of ashless dispersants.

The carboxylic dispersants generally are reaction products of substituted carboxylic acylating agents such as substituted carboxylic acids or derivatives thereof with (a) amines characterized by the presence within their structure of at least one >NH group, (b) organic hydroxy compounds such as phenols and alcohols, (c) basic inorganic materials such as reactive metal or reactive metal compounds, and (d) mixtures of two or more of (a) through (c). The dispersants which are obtained by the reaction of a substituted carboxylic acylating agent with an amine compound often are referred to as "acylated amine dispersants" or "carboxylic imide dispersants" such as succinimide dispersants. The ashless dispersants obtained by the reaction of a substituted carboxylic acylating agent with an alcohol or phenol generally are referred to as carboxylic ester dispersants.

The substituted carboxylic acylating agent may be derived from a monocarboxylic acid or a polycarboxylic acid. Polycarboxylic acids generally are preferred. The acylating agents may be a carboxylic acid or derivatives of the carboxylic acid such as the halides, esters, anhydrides, etc. The free carboxylic acids or the anhydrides of polycarboxylic acids are preferred acylating agents.

In one preferred embodiment, the ashless dispersants utilized in the lubricating oil compositions of the present invention are the acylated amines or dispersants obtained by reaction of a carboxylic acylating agent with at least one amine containing at least one hydrogen attached to a nitrogen group. In one preferred embodiment, the acylating agent is a hydrocarbon-substituted succinic acid acylating agent.

The nitrogen-containing carboxylic dispersants particularly useful as component (B) in the lubricating compositions of the present invention are known in the art and have been described in many U.S. patents including

| | | |
|---|---|---|
| 3,172,892 | 3,341,542 | 3,630,904 |
| 3,215,707 | 3,444,170 | 3,632,511 |
| 3,219,666 | 3,454,607 | 3,787,374 |
| 3,316,177 | 3,541,012 | 4,234,435 |

The above U.S. patents are expressly incorporated herein by reference for their teaching of the preparation of nitrogen-containing carboxylic dispersants useful as component (B).

In general, the nitrogen-containing carboxylic dispersants are produced by reacting (B-2-a) at least one substituted succinic acylating agent with (B-2-b) at least one amine compound containing at least one >HN group, and wherein said acylating agent consists of substituent groups and succinic groups wherein the substituent groups are derived from a polyalkene characterized by an $\overline{M}n$ value of at least about 700, and more generally from about 700 to about 5000. Generally, the reaction involves from about 0.5 equivalent to about 2 moles of the amine compound per equivalent of acylating agent.

Similarly, the carboxylic ester dispersants are prepared by reacting the carboxylic acylating agents described above with one or more alcohols or phenols in ratios of from about 0.5 equivalent to about 2 moles of hydroxy compound per equivalent of acylating agent. The preparation of carboxylic ester dispersant is described in the prior art such as U.S. Pat. Nos. 3,522,179 and 4,234,435.

The number of equivalents of the acylating agent depends on the total number of carboxylic functions present. In determining the number of equivalents for the acylating agents, those carboxyl functions which are not capable of reacting as a carboxylic acid acylating agent are excluded. In general, however, there is one equivalent of acylating agent for each carboxy group in these acylating agents. For example, there are two equivalents in an anhydride derived from the reaction of one mole of olefin polymer and one mole of maleic anhydride. Conventional techniques are readily available for determining the number of carboxyl functions (e.g., acid number, saponification number) and, thus, the number of equivalents of the acylating agent can be readily determined by one skilled in the art.

An equivalent weight of an amine or a polyamine is the molecular weight of the amine or polyamine divided by the total number of nitrogens (or >NH groups) present in the molecule. Thus, ethylene diamine has an equivalent weight equal to one-half of its molecular weight; diethylene triamine has an equivalent weight equal to one-third its molecular weight. The equivalent weight of a commercially available mixture of polyalkylene polyamine can be determined by dividing the atomic weight of nitrogen (14) by the % N contained in the polyamine and multiplying by 100; thus, a polyamine mixture containing 34% nitrogen would have an equivalent weight of 41.2. An equivalent weight of ammonia or a monoamine is the molecular weight.

An equivalent weight of a hydroxyl-substituted amine to be reacted with the acylating agents to form the carboxylic derivative (B) is its molecular weight divided by the total number of >NH and —OH groups present in the molecule. Thus, ethanolamine would have an equivalent weight equal to one-half of its molecular weight, and diethanolamine has an equivalent weight equal to one-third of its molecular weight.

The terms "substituent", "acylating agent" and "substituted succinic acylating agent" are to be given their normal meanings. For example, a substituent is an atom or group of atoms that has replaced another atom or group in a molecule as a result of a reaction. The terms acylating agent or substituted succinic acylating agent refer to the compound per se and does not include unreacted reactants used to form the acylating agent or substituted succinic acylating agent.

The acylated nitrogen compounds and carboxylic esters can be used directly as ashless dispersants in the compositions of the invention or they can be used as intermediates and post-treated with certain reagents as described more fully below.

The substituted succinic acylating agent (B-2-a) utilized the preparation of the carboxylic dispersant (B) can be characterized by the presence within its structure of two groups or moieties. The first group or moiety is referred to hereinafter, for convenience, as the "substituent group(s)" and is derived from a polyalkene. The polyalkene from which the substituted groups are derived is characterized by an $\overline{M}n$ (number average molecular weight) value of at least about 700. In one embodiment, the polyalkene is characterized by an $\overline{M}n$ value of about 700 to about 5000, and in another embodiment $\overline{M}n$ varies between about 700 to about 1200 or 1300.

In another embodiment the value of $\overline{M}n$ is generally higher and between 1300 to about 5000 with an $\overline{M}n$ value in the range of from about 1500 to about 5000 also being preferred. A more preferred $\overline{M}n$ value in this embodiment is one in the range of from about 1500 to about 2800. A most preferred range of $\overline{M}n$ values is from about 1500 to about 2400.

In yet another embodiment the substituent groups are derived from polyalkenes having an $\overline{M}n$ value of at least about 1300 up to about 5000, and the $\overline{M}w/\overline{M}n$ value is from about 1.5 to about 4. The preparation and use of substituted succinic acylating agents wherein the substituent is derived from such polyolefins are described in U.S. Pat. No. 4,234,435, the disclosure of which is hereby incorporated by reference.

Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC.

The techniques for determining $\overline{M}n$ and $\overline{M}w$ values of polymers are well known and are described in numerous books and articles. For example, methods for the determination of Mn and molecular weight distribution of polymers is described in W. W. Yan, J. J. Kirkland and D. D. Bly, "Modern Size Exclusion Liquid Chromatographs", J. Wiley & Sons, Inc., 1979.

The second group or moiety in the acylating agent is referred to herein as the "carboxylic group" or "succinic group(s)". The succinic groups are those groups characterized by the structure

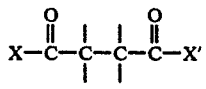

(I)

wherein X and X' are the same or different provided at least one of X and X' is such that the substituted succinic acylating agent can function as carboxylic acylating agents. That is, at least one of X and X' must be such that the substituted acylating agent can form amides or amine salts with amino compounds, and otherwise function as a conventional carboxylic acid acylating agents. Transesterification and transamidation reactions are considered, for purposes of this invention, as conventional acylating reactions.

Thus, X and/or X' is usually —OH, —O-hydrocarbyl, —O—M+ where M+ represents one equivalent of a metal, ammonium or amine cation, —$NH_2$, —Cl, —Br, and together, X and X' can be —O— so as to form the anhydride. The specific identity of any X or X' group which is not one of the above is not critical so long as its presence does not prevent the remaining group from entering into acylation reactions. Preferably, however, X and X' are each such that both carboxyl functions of the succinic group (i.e., both —C(O)X and —C(O)X' can enter into acylation reactions.

One of the unsatisfied valences in the grouping

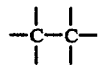

of Formula I forms a carbon carbon bond with a carbon atom in the substituent group. While other such unsatisfied valence may be satisfied by a similar bond with the same or different substituent group, all but the said one such valence is usually satisfied by hydrogen; i.e., —H.

In one preferred embodiment, the succinic groups will normally correspond to the formula

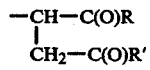

(II)

wherein R and R' are each independently selected from the group consisting of —OH, —Cl, —O-lower alkyl, and when taken together, R and R' are —O—. In the latter case, the succinic group is a succinic anhydride group. All the succinic groups in a particular succinic acylating agent need not be the same, but they can be the same. Preferably, the succinic groups will correspond to

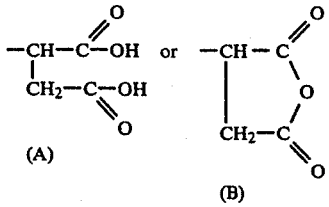

(III)

and mixtures of (III(A)) and (III(B)). Providing substituted succinic acylating agents wherein the succinic groups are the same or different is within the ordinary skill of the art and can be accomplished through conventional procedures such as treating the substituted succinic acylating agents themselves (for example, hydrolyzing the anhydride to the free acid or converting the free acid to an acid chloride with thionyl chloride) and/or selecting the appropriate maleic or fumaric reactants.

In addition to preferred substituted succinic groups where the preference depends on the number and identity of succinic groups for each equivalent weight of substituent groups, still further preferences are based on the identity and characterization of the polyalkenes from which the substituent groups are derived.

The polyalkenes from which the substituent groups are derived are homopolymers and interpolymers of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, "interpolymer(s)" as used herein is inclusive of copolymers, terpolymers, tetrapolymers, and the like. As will be apparent to those of ordinary skill in the art, the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e., >C=C<); that is, they are monoolefinic monomers such as ethylene, propylene, butene-1, isobutene, and octene-1 or polyolefinic monomers (usually diolefinic monomers) such as butadiene-1,3 and isoprene.

These olefin monomers are usually polymerizable terminal olefins; that is, olefins characterized by the presence in their structure of the group >C=$CH_2$. However, polymerizable internal olefin monomers (sometimes referred to in the literature as medial olefins) characterized by the presence within their structure of the group

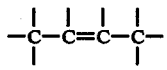

can also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin. Thus, 1,3-pentadiene (i.e., piperylene) is deemed to be a terminal olefin for purposes of this invention.

There is a general preference for aliphatic, hydrocarbon polyalkenes free from aromatic and cycloaliphatic groups. Within this general preference, there is a further preference for polyalkenes which are derived from the group consisting of homopolymers and interpolymers of terminal hydrocarbon olefins of 2 to about 16 carbon atoms. This further preference is qualified by the proviso that, while interpolymers of terminal olefins are usually preferred, interpolymers optionally containing up to about 40% of polymer units derived from internal olefins of up to about 16 carbon atoms are also within a preferred group. A more preferred class of polyalkenes are those selected from the group consisting of homopolymers and interpolymers of terminal olefins of 2 to about 6 carbon atoms, more preferably 2 to 4 carbon atoms. However, another preferred class of polyalkenes are the latter more preferred polyalkenes optionally containing up to about 25% of polymer units derived from internal olefins of up to about 6 carbon atoms. Polybutenes in which at least about 50% of the total units derived from butene are derived from isobutylene.

Obviously, preparing polyalkenes as described above which meet the various criteria for $\overline{M}n$ and $\overline{M}w/\overline{M}n$ is within the skill of the art and does not comprise part of the present invention. Techniques readily apparent to those in the art include controlling polymerization temperatures, regulating the amount and type of polymerization initiator and/or catalyst, employing chain terminating groups in the polymerization procedure, and the like. Other conventional techniques such as stripping (including vacuum stripping) a very light end and/or oxidatively or mechanically degrading high molecular weight polyalkene to produce lower molecular weight polyalkenes can also be used.

In preparing the substituted succinic acylating agents of this invention, one or more of the above-described polyalkenes is reacted with one or more acidic reactants selected from the group consisting of maleic or fumaric reactants of the general formula $$X(O)C—CH=CH—C(O)X' \quad (IV)$$

wherein X and X' are as defined hereinbefore in Formula I. Preferably the maleic and fumaric reactants will be one or more compounds corresponding to the formula $$RC(O)—CH=CH—C(O)R' \quad (V)$$

wherein R and R' are as previously defined in Formula II herein. Ordinarily, the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acylating agents of the present invention. The especially preferred reactants are maleic acid, maleic anhydride, and mixtures of these. Due to availability and ease of reaction, maleic anhydride will usually be employed.

The molar ratio of polyalkene to maleic reactant preferably is such that there is at least about one mole of maleic reactant for each mole of polyalkene. This is necessary in order that there can be at least 1.0 succinic group per equivalent weight of substituent group in the product. Preferably, however, an excess of maleic reactant is used. Thus, ordinarily about a 5% to about 25% excess of maleic reactant will be used relative to that amount necessary to provide the desired number of succinic groups in the product.

In another embodiment, the acylating agents are prepared by reacting the polyalkene with an excess of maleic anhydride to provide substituted succinic acylating agents wherein the number of succinic groups for each equivalent weight of substituent group is at least 1.3. The maximum number will not exceed 4.5. A suitable range is from about 1.4 to 3.5 and more specifically from about 1.4 to about 2.5 succinic groups per equivalent weight of substituent groups. In this embodiment, the value of $\overline{M}n$ is preferably between about 1300 and 5000. A more preferred range for $\overline{M}n$ is from about 1500 to about 2800, and a most preferred range of $\overline{M}n$ values is from about 1500 to about 2400.

Examples of patents describing various procedures for preparing useful acylating agents include U.S. Pat. Nos. 3,215,707 (Rense); 3,219,666 (Norman et al); 3,231,587 (Rense); 3,912,764 (Palmer); 4,110,349 (Cohen); and 4,234,435 (Meinhardt et al); and U.K. 1,440,219. The disclosures of these patents are hereby incorporated by reference.

For convenience and brevity, the term "maleic reactant" is often used hereinafter. When used, it should be understood that the term is generic to acidic reactants selected from maleic and fumaric reactants corresponding to Formulae (IV) and (V) above including a mixture of such reactants.

The acylating reagents described above are intermediates in processes for preparing the acylated nitrogen compositions (B-2) which may, per se, be used in the lubricants or may be used as intermediates and post-treated with various reagents as described below to form dispersants useful in the invention. The acylated nitrogen compositions (B-2) are prepared by reacting (B-2-a) one or more acylating reagents with (B-2-b) at least one amino compound characterized by the presence within its structure of at least one >HN group.

The amine (B-2-b) characterized by the presence within its structure of at least one HN< group can be a monoamine or polyamine compound. Mixtures of two or more amino compounds can be used in the reaction with one or more acylating reagents of this invention. Preferably, the amino compound contains at least one primary amino group (i.e., $—NH_2$) and more preferably the amine is a polyamine, especially a polyamine containing at least two —NH— groups, either or both of which are primary or secondary amines. The amines may be aliphatic, cycloaliphatic, aromatic or heterocyclic amines. The polyamines not only result in carboxylic acid derivative compositions which are usually more effective as dispersant/detergent additives, relative to derivative compositions derived from monoamines, but these preferred polyamines result in carboxylic derivative compositions which exhibit more pronounced V.I. improving properties.

Among the preferred amines are the alkylene polyamines, including the polyalkylene polyamines. The alkylene polyamines include those conforming to the formula $$\underset{\underset{R^3}{|}}{R^3N}—(U—\underset{\underset{R^3}{|}}{N})_n—R^3 \quad (VI)$$

wherein n is from 1 to about 10; each $R^3$ is independently a hydrogen atom, a hydrocarbyl group or a hydroxy-substituted or amine-substituted hydrocarbyl group having up to about 30 atoms, or two $R^3$ groups on different nitrogen atoms can be joined together to form a U group, with the proviso that at least one $R^3$ group is a hydrogen atom and U is an alkylene group of about 2 to about 10 carbon atoms. Preferably U is ethylene or propylene. Especially preferred are the alkylene polyamines where each $R^3$ is hydrogen or an amino-substituted hydrocarbyl group with the ethylene polyamines and mixtures of ethylene polyamines being the most preferred. Usually n will have an average value of from about 2 to about 7. Such alkylene polyamines include methylene polyamine, ethylene polyamines, butylene polyamines, propylene polyamines, pentylene polyamines, hexylene polyamines, heptylene polyamines, etc. The higher homologs of such amines and related amino alkyl-substituted piperazines are also included.

Alkylene polyamines useful in preparing the acylated nitrogen compositions (B-2) include ethylene diamine, triethylene tetramine, propylene diamine, trimethylene diamine, hexamethylene diamine, decamethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene)triamine, N-(2-aminoethyl)piperazine, 1,4-bis(2,aminoethyl)piperazine, and the like. Higher homologs as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7, pages 27–39, Interscience Publishers, Division of John Wiley and Sons, 1965, which is hereby incorporated by reference for the disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines. The mixtures are particularly useful in preparing the acylated nitrogen compounds (B-2) useful in this invention. On the other hand, quite satisfactory products can also be obtained by the use of pure alkylene polyamines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than two, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex. designated "E-100" showed a specific gravity at 15.6° C. of 1.0168, a percent nitrogen by weight of 33.15 and a viscosity at 40° C. of 121 centistokes. Gas chromatography analysis of such a sample showed it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylenetriamine, triethylenetetramine and the like.

These alkylene polyamine bottoms can be reacted solely with the acylating agent, in which case the amino reactant consists essentially of alkylene polyamine bottoms, or they can be used with other amines and polyamines, or alcohols or mixtures thereof. In these latter cases at least one amino reactant comprises alkylene polyamine bottoms.

Other polyamines which can be reacted with the acylating agents (B-2-a) in accordance with this invention are described in, for example, U.S. Pat. Nos. 3,219,666 and 4,234,435, and these patents are hereby incorporated by reference for their disclosures of amines which can be reacted with the acylating agents described above.

The acylated nitrogen compositions (B-2) produced from the acylating reagents (B-2-a) and the amines (B-2-b) described hereinbefore comprise acylated amines which include amine salts, amides, imides, etc., as well as mixtures thereof. To prepare the acylated nitrogen compounds from the acylating reagents and the amines, one or more acylating reagents and one or more amines are heated, optionally in the presence of a normally liquid, substantially inert organic liquid solvent/diluent, at temperatures in the range of about 80° C. up to the decomposition point (where the decomposition point is as previously defined) but normally at temperatures in the range of about 100° C. up to about 300° C. provided 300° C. does not exceed the decomposition point. Temperatures of about 125° C. to about 250° C. are normally used. The acylating reagent and the amine are reacted in amounts sufficient to provide from about one-half equivalent up to about 2 moles of amine per equivalent of acylating reagent.

Because the acylating reagents (B-2-a) can be reacted with the amine compounds (B-2-D) in the same manner as the high molecular weight acylating agents of the prior art are reacted with amines, U.S. Pat. Nos. 3,172,892; 3,219,666; 3,272,746; and 4,234,435 are expressly incorporated herein by reference for their disclosures with respect to the procedures applicable to reacting the acylating reagents with the amines as described above.

The amount of amine compound (B-2-b) within the above ranges that is reacted with the acylating agent (B-2-a) may also depend in part on the number and type of nitrogen atoms present. For example, a smaller amount of a polyamine containing one or more —$NH_2$ groups is required to react with a given acylating agent than a polyamine having the same number of nitrogen atoms and fewer or no —$NH_2$ groups. One —$NH_2$ group can react with two —COOH groups to form an imide. If only secondary nitrogens are present in the amine compound, each >NH group can react with only one —COOH group. Accordingly, the amount of polyamine within the above ranges to be reacted with the acylating agent to form the carboxylic derivatives of the invention can be readily determined from a consideration of the number and types of nitrogen atoms in the polyamine (i.e., $—NH_2$, $>NH$, and $>N—$).

The ratio of succinic groups to the equivalent weight of substituent group present in the acylating agent can be determined from the saponification number of the reacted mixture corrected to account for unreacted polyalkene present in the reaction mixture at the end of the reaction (generally referred to as filtrate or residue in the following examples). Saponification number is determined using the ASTM D-94 procedure. The formula for calculating the ratio from the saponification number is as follows:

$$\text{Ratio} = \frac{(\overline{Mn})\ (\text{Sap No., corrected})}{112{,}200\text{-}98\ (\text{Sap No., corrected})}$$

The corrected saponification number is obtained by dividing the saponification number by the percent of the polyalkene that has reacted. For example, if 10% of the polyalkene did not react and the saponification number of the filtrate or residue is 95, the corrected saponification number is 95 divided by 0.90 or 105.5.

The carboxylic dispersants (B) may be a carboxylic ester derivative compositions produced by reacting at least one substituted succinic acylating agent (B-2-a) with at least one alcohol or phenol of the general formula $$R^4(OH)_m \qquad \text{(VII)}$$

wherein $R^4$ is a monovalent or polyvalent organic group joined to the —OH groups through a carbon bond, and m is an integer of from 1 to about 10.

The carboxylic ester dispersants are those of the above-described succinic acylating agents with hydroxy compounds which may be aliphatic compounds such as monohydric and polyhydric alcohols or aromatic compounds such as phenols and naphthols. The aromatic hydroxy compounds from which the esters may be derived are illustrated by the following specific examples: phenol, beta-naphthol, alpha-naphthol, cresol, resorcinol, catechol, p,p'-dihydroxybiphenyl, 2-chlorophenol, 2,4-dibutylphenol, etc.

The alcohols from which the esters may be derived preferably contain up to about 40 aliphatic carbon atoms and more often from 2 to about 30 carbon atoms. They may be monohydric alcohols such as methanol, ethanol, isooctanol, dodecanol, cyclohexanol, etc. The polyhydric alcohols preferably contain from 2 to about 10 hydroxy groups. They are illustrated by, for example, ethylene glycol, diethylene glycol, triethylene glycol, tetraethylene glycol, dipropylene glycol, tripropylene glycol, dibutylene glycol, tributylene glycol, and other alkylene glycols in which the alkylene group contains from 2 to about 8 carbon atoms.

An especially preferred class of polyhydric alcohols are those having at least three hydroxy groups, some of which have been esterified with a monocarboxylic acid having from about 8 to about 30 carbon atoms such as octanoic acid, oleic acid, stearic acid, linoleic acid, dodecanoic acid, or tall oil acid. Examples of such partially esterified polyhydric alcohols are the monooleate of sorbitol, distearate of sorbitol, monooleate of glycerol, monostearate of glycerol, di-dodecanoate of erythritol.

The carboxylic ester dispersants (B) may be prepared by one of several known methods. The method which is preferred because of convenience and the superior properties of the esters it produces, involves the reaction of a suitable alcohol or phenol with a substantially hydrocarbon-substituted succinic anhydride. The esterification is usually carried out at a temperature above about 100° C., preferably between 150° C. and 300° C. The water formed as a by-product is removed by distillation as the esterification proceeds.

The relative proportions of the succinic reactant and the hydroxy reactant which are to be used depend to a large measure upon the type of the product desired and the number of hydroxyl groups present in the molecule of the hydroxy reactant. For instance, the formation of a half ester of a succinic acid, i.e., one in which only one of the two acid groups is esterified, involves the use of one mole of a monohydric alcohol for each mole of the substituted succinic acid reactant, whereas the formation of a diester of a succinic acid involves the use of two moles of the alcohol for each mole of the acid. On the other hand, one mole of a hexahydric alcohol may combine with as many as six moles of a succinic acid to form an ester in which each of the six hydroxyl groups of the alcohol is esterified with one of the two acid groups of the succinic acid. Thus, the maximum proportion of the succinic acid to be used with a polyhydric alcohol is determined by the number of hydroxyl groups present in the molecule of the hydroxy reactant. In one embodiment, esters obtained by the reaction of equimolar amounts of the succinic acid reactant and hydroxy reactant are preferred.

Methods of preparing the carboxylic ester dispersants (B) are well known in the art and need not be illustrated in further detail here. For example, see U.S. Pat. No. 3,522,179 which is hereby incorporated by reference for its disclosures of the preparation of carboxylic ester compositions useful as component (B). The preparation of carboxylic ester derivative compositions from acylating agents wherein the substituent groups are derived from polyalkenes characterized by an $\overline{Mn}$ of at least about 1300 up to about 5000 and an $\overline{Mw}/\overline{Mn}$ ratio of from 1.5 to about 4 is described in U.S. Pat. No. 4,234,435 which was incorporated by reference earlier. As noted above, the acylating agents described in the '435 patent are also characterized as having within their structure an average of at least 1.3 succinic groups for each equivalent weight of substituent groups.

The carboxylic ester derivatives which are described above resulting from the reaction of an acylating agent with a hydroxy containing compound such as an alcohol or a phenol may be further reacted with an amine, and particularly polyamines in the manner described previously for the reaction of the acylating agent (B-2-a) with amines (B-2-b) in preparing dispersant (B). In one embodiment, the amount of amine which is reacted with the ester is an amount such that there is at least about 0.01 equivalent of the amine for each equivalent of acylating agent initially employed in the reaction with the alcohol. Where the acylating agent has been reacted with the alcohol in an amount such that there is at least one equivalent of alcohol for each equivalent of acylating agent, this small amount of amine is sufficient to react with minor amounts of non-esterified carboxyl groups which may be present. In one preferred embodiment, the amine-modified carboxylic acid ester dispersants are prepared by reacting about 1.0 to 2.0 equivalents, preferably about 1.0 to 1.8 equivalents of hydroxy compounds, and up to about 0.3 equivalent, preferably about 0.02 to about 0.25 equivalent of polyamine per equivalent of acylating agent.

In another embodiment, the carboxylic acid acylating agent may be reacted simultaneously with both the alcohol and the amine. There is generally at least about 0.01 equivalent of the alcohol and at least 0.01 equivalent of the amine although the total amount of equivalents of the combination should be at least about 0.5 equivalent per equivalent of acylating agent. These carboxylic ester dispersant compositions (B) are known in the art, and the preparation of a number of these derivatives is described in, for example, U.S. Pat. Nos. 3,957,854 and 4,234,435 which have been incorporated by reference previously.

The above-described acylated amines and carboxylic esters are effective dispersants in the lubricating compositions of the invention. In another embodiment, these compositions may be considered as intermediates and post-treated with one or more post-treating reagents selected from the group consisting of boron trioxide, boron anhydrides, boron halides, boron acids, boron amides, esters of boric acids, carbon disulfide, hydrogen sulfide, sulfur, sulfur chlorides, alkenyl cyanides, carboxylic acid acylating agents, aldehydes, ketones, urea, thiourea, guanidine, dicyanodiamide, hydrocarbyl phosphates, hydrocarbyl phosphites, hydrocarbyl thiophosphates, hydrocarbyl thiophosphites, phosphorus sulfides, phosphorus oxides, phosphoric acid, hydrocarbyl thiocyanates, hydrocarbyl isocyanates, hydrocarbyl isothiocyanates, epoxides, episulfides, formaldehyde or formaldehyde-producing compounds with phenols, and sulfur with phenols. These post-treating reagents can be used with carboxylic derivative compositions prepared from the acylating reagents and a combination of amines and alcohols as described above.

Since processes involving the use of these post-treating reagents is known insofar as application to reaction products of high molecular weight carboxylic acid acylating agents and amines and/or alcohols, a detailed description of these processes herein is believed unnecessary. The following U.S. patents are expressly incorporated herein by reference for their disclosure of post-treating processes and post-treating reagents applicable to the carboxylic derivative compositions of this invention: U.S. Pat. Nos. 3,087,936; 3,254,025; 3,256,185; 3,278,550; 3,282,955; 3,284,410; 3,338,832; 3,533,945; 3,639,242; 3,708,522; 3,859,318; 3,865,813; etc. U.K. Patent Nos. 1,085,903 and 1,162,436 also describe such processes.

Particularly useful as ashless dispersants in the lubricating compositions of the present invention are boron-containing compositions prepared from the acylated nitrogen compounds described above. Thus, preferred dispersants contained nitrogen and boron and are prepared by reacting (B-1) a boron compound selected from the group consisting of boron trioxide, boron anhydrides, boron halides, boron acids, boron amides, esters of boric acid and mixtures thereof with (B-2) at least one acylated nitrogen intermediate prepared by the reaction of (B-2-a) at least one substituted succinic acylating agent with (B-2-b) at least about one-half equivalent, per equivalent of acylating agent, of an amine characterized by the presence within its structure of at least one >NH group wherein said substituted succinic acylating agent consists of substituent groups and succinic groups, and the substituent groups are derived from polyalkene characterized as having an $\overline{M}n$ value of at least about 700.

The acylated nitrogen intermediate (B-2) described above is identical to the acylated nitrogen compositions (B-2) also described above which have not been reacted with a boron compound. The amount of boron compound reacted with the acylated nitrogen intermediate (B-2) generally is sufficient to provide from about 0.1 atomic proportion of boron for each mole of the acylated nitrogen composition up to about 10 atomic proportions of boron for each atomic proportion of nitrogen of said acylated nitrogen composition. More generally the amount of boron compound present is sufficient to provide from about 0.5 atomic proportion of boron for each mole of the acylated nitrogen composition to about 2 atomic proportions of boron for each atomic proportion of nitrogen used.

The boron compounds (B-1) useful in the present invention include boron oxide, boron oxide hydrate, boron trioxide, boron trifluoride, boron tribromide, boron trichloride, boron acids such as boronic acid (i.e., alkyl-$B(OH)_2$ or aryl-$B(OH)_2$), boric acid (i.e., $H_3BO_3$), tetraboric acid (i.e., $H_2B_4O_7$), metaboric acid (i.e., $HBO_2$), boron anhydrides, boron amides and various esters of such boron acids. The use of complexes of boron trihalide with ethers, organic acids, inorganic acids, or hydrocarbons is a convenient means of introducing the boron reactant into the reaction mixture. Such complexes are known and are exemplified by boron-trifluoride-triethyl ester, boron trifluoride-phosphoric acid, boron trichloride-chloroacetic acid, boron tribromide-dioxane, and boron trifluoride-methyl ethyl ether.

Specific examples of boronic acids include methyl boronic acid, phenyl-boronic acid, cyclohexyl boronic acid, p-heptylphenyl boronic acid and dodecyl boronic acid.

The boron acid esters include especially mono-, di-, and tri-organic esters of boric acid with alcohols or phenols such as, e.g., methanol, ethanol, isopropanol, cyclohexanol, cyclopentanol, 1-octanol, 2-octanol, dodecanol, behenyl alcohol, oleyl alcohol, stearyl alcohol, benzyl alcohol, 2-butyl cyclohexanol, ethylene glycol, propylene glycol, trimethylene glycol, 1,3-butanediol, 2,4-hexanediol, 1,2-cyclohexanediol, 1,3-octanediol, glycerol, pentaerythritol diethylene glycol, carbitol, Cellosolve, triethylene glycol, tripropylene glycol, phenol, naphthol, p-butylphenol, o,p-diheptylphenol, n-cyclohexylphenol, 2,2 -bis-(p-hydroxyphenyl) propane, polyisobutene (molecular weight of 1500)-substituted phenol, ethylene chlorohydrin, o-chlorophenol, m-nitrophenol, 6-bromo-octanol, and 7-keto-decanol. Lower alcohols, 1,2-glycols, and 1 -3-glycols, i.e., those having less than about 8 carbon atoms are especially useful for preparing the boric acid esters for the purpose of this invention.

Methods for preparing the esters of boron acid are known and disclosed in the art (such as "Chemical Reviews," pp. 959–1064, Vol. 56). Thus, one method involves the reaction of boron trichloride with 3 moles of an alcohol or a phenol to result in a tri-organic borate. Another method involves the reaction of boric oxide with an alcohol or a phenol. Another method involves the direct esterification of tetra boric acid with 3 moles of an alcohol or a phenol. Still another method involves the direct esterification of boric acid with a glycol to form, e.g., a cyclic alkylene borate.

The reaction of the acylated nitrogen intermediate (B-2) with the boron compounds (B-1) can be effected simply by mixing the reactants at the desired temperature. The use of an inert solvent is optional although it is often desirable, especially when a highly viscous or solid reactant is present in the reaction mixture. The inert solvent may be a hydrocarbon such as benzene, toluene, naphtha, cyclohexane, n-hexane, or mineral oil. The temperature of the reaction may be varied within wide ranges. Ordinarily it is preferably between about 50° C. and about 250° C. In some instances it may be 25° C. or even lower. The upper limit of the temperature is the decomposition point of the particular reaction mixture and/or product.

The reaction is usually complete within a short period such as 0.5 to 6 hours. After the reaction is complete, the product may be dissolved in the solvent and the resulting solution purified by centrifugation or filtration if it appears to be hazy or contain insoluble substances. Ordinarily the product is sufficiently pure so that further purification is unnecessary or optional.

The reaction of the acylated nitrogen compositions with the boron compounds results in a product containing boron and substantially all of the nitrogen originally present in the nitrogen reactant. It is believed that the reaction results in the formation of a complex between boron and nitrogen. Such complex may involve in some instances more than one atomic proportion of boron with one atomic proportion of nitrogen and in other instances more than one atomic proportion of nitrogen with one atomic proportion of boron. The nature of the complex is not clearly understood.

Inasmuch as the precise stoichiometry of the complex formation is not known, the relative proportions of the reactants to be used in the process are based primarily upon the consideration of utility of the products for the purposes of this invention. In this regard, useful products are obtained from reaction mixtures in which the reactants are present in relative proportions as to provide from about 0.1 atomic proportions of boron for each mole of the acylated nitrogen composition used to about 10 atomic proportions of boron for each atomic proportion of nitrogen of said acylated nitrogen composition used. The preferred amounts of reactants are such as to provide from about 0.5 atomic proportion of boron for each mole of the acylated nitrogen composition to about 2 atomic proportions of boron for each atomic proportion of nitrogen used. To illustrate, the amount of a boron compound having one boron atom per molecule to be used with one mole of an acylated nitrogen composition having five nitrogen atoms per molecule is within the range from about 0.1 mole to about 50 moles, preferably from about 0.5 mole to about 10 moles.

The following examples are illustrative of the process for preparing the nitrogen-containing and the nitrogen- and boron-containing compositions useful as ashless dispersants (B) in this invention:

EXAMPLE B-1

A polyisobutenyl succinic anhydride is prepared by the reaction of a chlorinated polyisobutylene with maleic anhydride at 200° C. The polyisobutenyl group has a number average molecular weight of about 850 and the resulting alkenyl succinic anhydride is found to have an acid number of 113 (corresponding to an equivalent weight of 500). To a mixture of 500 grams (1 equivalent) of this polyisobutenyl succinic anhydride and 160 grams of toluene there is added at room temperature 35 grams (1 equivalent) of diethylene triamine. The addition is made portionwise throughout a period of 15 minutes, and an initial exothermic reaction caused the temperature to rise to 50° C. The mixture then is heated and a water-toluene azeotrope distilled from the mixture. When no more water distilis, the mixture is heated to 150° C. at reduced pressure to remove the toluene. The residue is diluted with 350 grams of mineral oil and this solution is found to have a nitrogen content of 1.6%.

EXAMPLE B-2

The procedure of Example B-1 is repeated using 31 grams (1 equivalent) of ethylene diamine as the amine reactant. The nitrogen content of the resulting product is 1.4%.

EXAMPLE B-3

The procedure of Example B-1 is repeated using 55.5 grams (1.5 equivalents) of an ethylene amine mixture having a composition corresponding to that of triethylene tetramine. The resulting product has a nitrogen content of 1.9%.

EXAMPLE B-4

The procedure of Example B-1 is repeated using 55.0 grams (1.5 equivalents) of triethylene tetramine as the amine reactant. The resulting product has a nitrogen content of 2.9%.

EXAMPLE B-5

To a mixture of 140 grams of toluene and 400 grams (0.78 equivalent) of a polyisobutenyl succinic anhydride (having an acid number of 109 and prepared from maleic anhydride and the chlorinated polyisobutylene of Example B-1) there is added at room temperature 63.6 grams (1.55 equivalents) of a commercial ethylene amine mixture having an average composition corresponding to that of tetraethylene pentamine. The mixture is heated to distill the water-toluene azeotrope and then to 150° C. at reduced pressure to remove the remaining toluene. The residual polyamide has a nitrogen content of 4.7%.

EXAMPLE B-6

A polyisobutenyl succinic anhydride having an acid number of 105 and an equivalent weight of 540 is prepared by the reaction of a chlorinated polyisobutylene (having a number average molecular weight of 1050 and a chlorine content of 4.3%) and maleic anhydride. To a mixture of 300 parts by weight of the polyisobutenyl succinic anhydride and 160 parts by weight of mineral oil there is added at 65°-95° C. an equivalent amount (25 parts by weight) of the commercial ethylene amine mixture of Example B-5. This mixture then is heated to 150° C. to distill all of the water formed in the reaction. Nitrogen is bubbled through the mixture at this temperature to insure removal of the last traces of water. The residue is an oil solution of the desired product.

EXAMPLE B-7

A polypropylene-substituted succinic anhydride having an acid number of 84 is prepared by the reaction of a chlorinated polypropylene having a chlorine content of 3% and a number average molecular weight of 1200 with maleic anhydride. A mixture of 813 grams of the polypropylene-substituted succinic anhydride, 50 grams of a commercial ethylene amine mixture having an average composition corresponding to that of tetraethylene pentamine and 566 grams of mineral oil is heated at 150° C. for 5 hours. The residue is found to have a nitrogen content of 1.18%.

EXAMPLE B-8

An acylated nitrogen composition is prepared according to the procedure of Example B-1 except that the reaction mixture consists of 3880 grams of the polyisobutenyl succinic anhydride, 376 grams of a mixture of triethylene tetramine and diethylene triamine (75:25 weight ratio), and 2785 grams of mineral oil. The product is found to have a nitrogen content of 2%.

EXAMPLE B-9

An acylated nitrogen composition is prepared according to the procedure of Example B-1 except that the reaction mixture consists of 1385 grams of the polyisobutenyl succinic anhydride, 179 grams of a mixture of triethylene tetramine and diethylene triamine (75:25 weight ratio), and 1041 grams of mineral oil. The product is found to have a nitrogen content of 2.55%.

EXAMPLE B-10

An acylated nitrogen composition is prepared according to the procedure of Example B-7 except that the polyisobutene-substituted succinic anhydride of Example B-1 (1 equivalent for 1.5 equivalents of the amine reactant) is substituted for the polypropylene-substituted succinic anhydride used.

EXAMPLE B-11

An acylated nitrogen composition is prepared according to the procedure of Example B-7 except that the polyisobutene-substituted succinic anhydride of Example B-1 (1 equivalent for 2 equivalents of the amine reactant) is substituted for the polypropylene-substituted succinic anhydride used.

EXAMPLE B-12

An acylated nitrogen composition is prepared according to the procedure of Example B-4 except that the commercial ethylene amine mixture (1.5 equivalent per equivalent of the anhydride) of Example B-6 is substituted for the triethylene tetramine used.

EXAMPLE B-13

An acylated nitrogen composition is prepared according to the procedure of Example B-7 except that the polyisobutene-substituted succinic anhydride of Example B-1 (1 equivalent for 1 equivalent of the amine reactant) is substituted for the polypropylene-substituted succinic anhydride. The composition is found to have a nitrogen content of 1.5%.

EXAMPLE B-14

(a) A mixture of 510 parts (0.28 mole) of polyisobutene ($\overline{M}n=1845$; $\overline{M}w=5325$) and 59 parts (0.59 mole) of maleic anhydride is heated to 110° C. This mixture is heated to 190° C. in 7 hours during which 43 parts (0.6 mole) of gaseous chlorine is added beneath the surface. At 190°-192° C. an additional 11 parts (0.16 mole) of chlorine is added over 3.5 hours. The reaction mixture is stripped by heating at 190°-193° C. with nitrogen blowing for 10 hours. The residue is the desired polyisobutene-substituted succinic acylating agent having a saponification equivalent number of 87 as determined by ASTM procedure D-94.

(b) A mixture is prepared by the addition of 10.2 parts (0.25 equivalent) of a commercial mixture of ethylene polyamines having from about 3 to about 10 nitrogen atoms per molecule to 113 parts of mineral oil and 161 parts (0.25 equivalent) of the substituted succinic acylating agent at 130° C. The reaction mixture is heated to 150° C. in 2 hours and stripped by blowing with nitrogen. The reaction mixture is filtered to yield the filtrate as an oil solution of the desired product.

EXAMPLE B-15

(a) A mixture of 1000 parts (0.495 mole) of polyisobutene ($\overline{M}n=2020$; $\overline{M}w=6049$) and 115 parts (1.17 moles) of maleic anhydride is heated to 110° C. This mixture is heated to 184° C. in 6 hours during which 85 parts (1.2 moles) of gaseous chlorine is added beneath the surface. At 184°-189° C., an additional 59 parts (0.83 mole) of chlorine is added over 4 hours. The reaction mixture is stripped by heating at 186°-190° C. with nitrogen blowing for 26 hours. The residue is the desired polyisobutene-substituted succinic acylating agent having a saponification equivalent number of 87 as determined by ASTM procedure D-94.

(b) A mixture is prepared by the addition of 57 parts (1.38 equivalents) of a commercial mixture of ethylene polyamines having from about 3 to 10 nitrogen atoms per molecule to 1067 parts of mineral oil and 893 parts (1.38 equivalents) of the substituted succinic acylating agent at 140°-145° C. The reaction mixture is heated to 155° C. in 3 hours and stripped by blowing with nitrogen. The reaction mixture is filtered to yield the filtrate as an oil solution of the desired product.

EXAMPLE B-16

A mixture is prepared by the addition of 18.2 parts (0.433 equivalent) of a commercial mixture of ethylene polyamines having from about 3 to 10 nitrogen atoms per molecule to 392 parts of mineral oil and 348 parts (0.52 equivalent) of the substituted succinic acylating agent prepared in Example B-15 at 140° C. The reaction mixture is heated to 150° C. in 1.8 hours and stripped by blowing with nitrogen. The reaction mixture is filtered to yield the filtrate as an oil solution of the desired product.

EXAMPLE B-17

To 600 grams (1 atomic proportion of nitrogen) of the acylated nitrogen composition prepared according to the process of Example B-13 there is added 45.5 grams (0.5 atomic proportion of boron) of boron trifluoride-diethyl ether complex (1:1 molar ratio) at 60°-75° C. The resulting mixture is heated to 103° C. and then at 110° C./30 mm. to distill off all volatile components. The residue is found to have a nitrogen content of 1.44% and a boron content of 0.49%.

EXAMPLE B-18

A mixture of 62 grams (1 atomic proportion of boron) of boric acid and 1645 grams (2.35 atomic proportions of nitrogen) of the acylated nitrogen composition obtained by the process of Example B-8 is heated at 150° C. in nitrogen atmosphere for 6 hours. The mixture is then filtered and the filtrate is found to have a nitrogen content of 1.94% and a boron content of 0.33%.

EXAMPLE B-19

An oleyl ester of boric acid is prepared by heating an equi-molar mixture of oleyl alcohol and boric acid in toluene at the reflux temperature while water is removed azeotropically. The reaction mixture is then heated to 150° C./20 mm. and the residue is the ester having a boron content of 3.2% and a saponification number of 62. A mixture of 344 grams (1 atomic proportion of boron) of the ester and 1645 grams (2.35 atomic proportions of nitrogen) of the acylated nitrogen composition obtained by the process of Example B-8 is heated at 150° C. for 6 hours and then filtered. The filtrate is found to have a boron content of 0.6% and a nitrogen content of 1.74%.

EXAMPLE B-20

A mixture of 372 grams (6 atomic proportions of boron) of boric acid and 3111 grams (6 atomic proportions of nitrogen) of the acylated nitrogen composition obtained by the process of Example B-11 is heated at 50° C. for 3 hours and then filtered. The filtrate is found to have a boron content of 1.64% and a nitrogen content of 2.56%.

EXAMPLE B-21

Boric acid (124 grams, 2 atomic proportions of boron) is added to the acylated nitrogen composition (556 grams, 1 atomic proportion of nitrogen) obtained according to the procedure of Example B-11. The resulting mixture is heated at 150° C. for 3.5 hours and filtered at that temperature. The filtrate is found to have a boron compound of 3.23% and a nitrogen content of 2.3%.

EXAMPLE B-22

A mixture of 62 parts of boric acid and 2720 parts of the oil solution of the product prepared in Example B-15 is heated at 150° C. under nitrogen for 6 hours. The reaction mixture is filtered to yield the filtrate as an oil solution of the desired boron-containing product.

EXAMPLE B-23

An oleyl ester of boric acid is prepared by heating an equimolar mixture of oleyl alcohol and boric acid in toluene at the reflux temperature while water is removed azeotropically. The reaction mixture is then heated to 150° C. under vacuum and the residue is the ester having a boron content of 3.2% and a saponification number of 62. A mixture of 344 parts of the heater and 2720 parts of the oil solution of the product prepared in Example B-15 is heated at 150° C. for 6 hours and then filtered. The filtrate is an oil solution of the desired boron-containing product.

EXAMPLE B-24

Boron trifluoride (34 parts) is bubbled into 190 parts of the oil solution of the product prepared in Example B-16 at 80° C. within a period of 3 hours. The resulting mixture is blown with nitrogen at 70°-80° C. for 2 hours to yield the residue as an oil solution of the desired product.

EXAMPLE B-25

A mixture of 1000 parts by weight of a substituted succinic acylating agent prepared as in Example B-1 utilizing a polyisobutene having a number average molecular weight of about 950 and 275 parts by weight of mineral oil is prepared and heated to about 110° C. whereupon nitrogen is blown through the mixture. To this mixture there are added 147 parts of a commercial mixture of ethylene polyamines containing from about 3 to about 10 nitrogen atoms per molecular (and containing 34% nitrogen) over a period of about one hour. After substantially all of the water has been removed at an elevated temperature, a filter aid is added, and the reaction mixture is filtered at about 150° C. The filtrate is an oil solution of the desired succinic acylated amine intermediate.

To 1405 parts by weight of the intermediate there is added a slurry prepared from 239 parts of boric acid and 398 parts of mineral oil. The mixture is heated to about 150° C. in a nitrogen atmosphere for about 6 hours. The mixture then is filtered and the filtrate is an oil solution of the desired nitrogen and boron-containing composition having a nitrogen content of 2.3% and a boron content of 1.8%.

The following examples illustrate the carboxylic ester dispersants (B) and the processes for preparing such esters.

EXAMPLE B-26

A substantially hydrocarbon-substituted succinic anhydride is prepared by chlorinating a polyisobutene having a number average molecular weight of 1000 to a chlorine content of 4.5% and then heating the chlorinated polyisobutene with 1.2 molar proportions of maleic anhydride at a temperature of 150°-220° C. The succinic anhydride thus obtained has an acid number of 130. A mixture of 874 grams (1 mole) of the succinic anhydride and 104 grams (1 mole) of neopentyl glycol is maintained at 240°-250° C./30 mm for 12 hours. The residue is a mixture of the esters resulting from the esterification of one and both hydroxy groups of the glycol. It has a saponification number of 101 and an alcoholic hydroxyl content of 0.2%.

EXAMPLE B-27

(a) The dimethyl ester of the substantially hydrocarbon-substituted succinic anhydride of Example B-26 is prepared by heating a mixture of 2185 grams of the anhydride, 480 grams of methanol, and 1000 cc of toluene at 50°-65° C. while hydrogen chloride is bubbled through the reaction mixture for 3 hours. The mixture is then heated at 60°-65° C. for 2 hours, dissolved in benzene, washed with water, dried and filtered. The filtrate is heated at 150° C./60 mm to remove volatile components. The residue is the desired dimethyl ester.

(b) A mixture of 334 parts (0.52 equivalent) of the dimethyl ester prepared in (a), 548 parts of mineral oil, 30 parts (0.88 equivalent) of pentaerythritol and 8.6 parts (0.0057 equivalent) of Polyglycol 112-2 demulsifier from Dow Chemical Company is heated at 150° C. for 2.5 hours. The reaction mixture is heated to 210° C. in 5 hours and held at 210° C. for 3.2 hours. The reaction mixture is cooled to 190° C. and 8.5 parts (0.2 equivalent) of a commercial mixture of ethylene polyamines having an average of about 3 to about 10 nitrogen atoms per molecule are added. The reaction mixture is stripped by heating at 205° C. with nitrogen blowing for 3 hours, then filtered to yield the filtrate as an oil solution of the desired product.

EXAMPLE B-28

(a) A mixture of 1000 parts of polyisobutene having a number average molecular weight of about 1000 and 108 parts (1.1 moles) of maleic anhydride is heated to about 190° C. and 100 parts (1.43 moles) of chlorine are added beneath the surface over a period of about 4 hours while maintaining the temperature at about 185°-190° C. The mixture then is blown with nitrogen at this temperature for several hours, and the residue is the desired polyisobutene-substituted succinic acylating agent.

(b) A solution of 1000 parts of the above-prepared acylating agent in 857 parts of mineral oil is heated to about 150° C. with stirring, and 109 parts (3.2 equivalents) of pentaerythritol are added with stirring. The mixture is blown with nitrogen and heated to about 200° C. over a period of about 14 hours to form an oil solution of the desired carboxylic ester intermediate. To the intermediate, there are added 19.25 parts (0.46 equivalent) of a commercial mixture of ethylene polyamines having an average of about 3 to about 10 nitrogen atoms per molecule. The reaction mixture is stripped by heating at 205° C. with nitrogen blowing for 3 hours and filtered. The filtrate is an oil solution (45% oil) of the desired amine-modified carboxylic ester which contains 0.35% nitrogen.

The amount of ashless dispersant utilized in the lubricating compositions of the present invention is an amount which is effective to provide the desired dispersant characteristics. The ashless dispersants, and in particular, the nitrogen and boron-containing dispersants described above also provide rust-inhibiting properties to the lubricating composition. In general from about 0.05 to about 30 parts by weight of the ashless dispersant is included in the lubricating composition. More often, from about 0.1 to about 15 parts by weight of the ashless dispersant results in the satisfactory lubricant, and in one preferred embodiment, the lubricating compositions contain from about 0.1 to about 10% by weight of the nitrogen- and boron-containing composition (B).

(C) The Demulsifier

The lubricating compositions of the present invention also contain a minor, effective amount of at least one demulsifier characterized by the formula

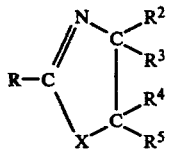

(VIII)

wherein R is a hydrocarbyl group, $R^2$, $R^3$, $R^4$ and $R^5$ are each independently H or hydrocarbyl groups, and X is O or NR' wherein R' is hydrogen or a hydrocarbyl group. As can be seen from the formula, the demulsifiers (C) utilized in the present invention may be either oxazoline or imidazoline derivatives. In a preferred embodiment, $R^2$ and $R^3$ are hydrogen and R is an aliphatic or alicyclic hydrocarbon-based group containing from about 5 to about 40 or more carbon atoms. In another preferred embodiment, R is an alkyl or alkenyl group containing from 5 to about 40 or more carbon atoms, more generally from about 5 to about 30 carbon atoms. In one preferred embodiment, R is an alkenyl group containing from about 9 to about 25 carbon atoms.

In one preferred embodiment, the demulsifier is an imidazoline characterized by the formula

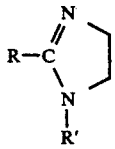

(IX)

wherein R is an alkyl or alkenyl group containing from about 5 to about 30 carbon atoms, and R' is hydrogen or a hydrocarbyl group containing from 1 to about 8 carbon atoms. Generally, the hydrocarbyl group (R') will contain at least one >NH or —OH group. One type of imidazoline demulsifier which is useful in the present invention is characterized by the following formula

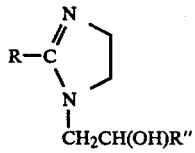

(X)

wherein R is a hydrocarbyl group containing about 5 to about 30 carbon atoms and R'' is H or a hydrocarbyl group containing from 1 to about 6 carbon atoms.

Examples of oxazolines which can be utilized in the present invention include those characterized by formula XI

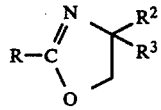

(XI)

where R is undecyl, dodecyl, heptadecenyl-1, hexadecenyl-1, etc. $R^2$ and $R^3$ are hydrogen, hydroxy ethyl, hydroxy methyl, etc.

The preparation of the above and other oxazolines of the type characterized by Formula VIII is described in the patent literature such as U.S. Pat. Nos. 2,329,619; 2,905,644; and 4,256,592 and publications such as the chapter by R. H. Wiley and L. L. Bennett, Jr. in *Chem Reviews*, June, 1949, Vol. 44, pp. 447–476.

Non-limiting examples of imidazolines which can be utilized as demulsifiers in the lubricating compositions of the present invention include 1-(5-hydroxypentyl)-2-dodecylimidazoline; 1-(2-hydroxyethyl)-2-(3-cyclohexylpropyl)imidazoline; 1-(2-hydroxyethyl)-2-dodecylcyclohexylimidazoline; 1-(4-hydroxybutyl)-2-(1-heptadecenyl)imidazoline; 1-butyl-2-heptadecenylimidazoline; 1-(2-aminoethyl)-2-tridecylimidazoline; 1-(2-aminoethyl)-2-(1-heptadecenyl)imidazoline; 1-(2-hydroxyethyl)-2-(1ethylpentyl)imidazoline; etc.

Imidazolines such as those exemplified above can be prepared by methods such as those disclosed in U.S. Pat. Nos. 2,267,965 and 2,214,152. Generally, the imidazolines are readily formed by reacting an aliphatic or alicyclic carboxylic acid with an appropriate unsubstituted hydrocarbon-based group substituted ethylene diamine. The reaction involves the condensation of the acid with the diamine at a temperature ranging from about 110° C. to about 350° C. with the elimination of two moles of water.

The aliphatic or alicyclic carboxylic acid reacted with the amine to form the imidazoline may be saturated or unsaturated and may contain substituents as halo, ether, sulfide, keto, hydroxo, etc., as well as phenyl, tolyl, xylyl, chlorophenyl, hydroxyphenyl, naphthyl, etc. Representative, but non-limiting examples of acids useful for the preparation of the imidazolines adapted for the purposes of this invention include undecanoic acid, myristic acid, palmitic, stearic, oleic, linoleic, linolenic, ricinoleic, phenylstearic, xylylstearic, chlorostearic, hydroxy phenylstearic, tricosanoic, and mixtures of any of these acids. The reaction of a carboxylic acid with a diamine to form an imidazoline is illustrated as follows:

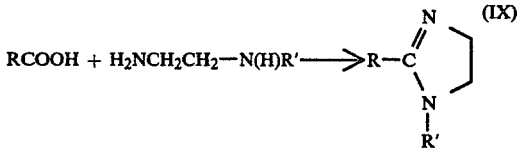

where R and R' have the same meaning as given previously for Formula IX.

The amount of the demulsifier (C) incorporated into the lubricating composition of the present invention is an amount which is effective to demulsify any emulsion which forms when the lubricating oil compositions of the present invention are mixed with water as may occur during use or storage. In one embodiment, the lubricating compositions of the present invention contain from about 0.01 to about 1% by weight, and more particularly from 0.02 to about 0.2% by weight based on the weight of the lubricating composition, and such amounts are sufficient to provide the desired demulsibility properties. It also has been observed that the incorporation of the imidazoline demulsifiers into the lubricating compositions of the present invention provides desirable anti-wear properties to the lubricating composition. In one preferred embodiment, the lubricating compositions of the present invention will contain from about 0.4 to about 0.8% by weight of the nitrogen-and boron-containing carboxylic dispersants (B) and about 0.2% by weight of imidazole demulsifier (C).

(D) Supplemental Demulsifiers

Although the incorporation of the above ashless dispersants (B) and demulsifiers (C) provide lubricating oil compositions of the present invention having desirable characteristics, the incorporation of supplemental demulsifiers (D) into the lubricating compositions results in improved demulsibility, and in particular, a reduction in the water separation time. Particularly useful as supplemental demulsifiers are low molecular weight polyoxyalkylene glycols such as polyethylene glycol, polypropylene glycol, low molecular weight polymers containing ethylene and propylene moieties and derived from mixtures of ethylene glycol and propylene glycol, and/or glycols reacted with ethylene oxide and/or propylene oxide. A description of various types of polyoxyalkylene glycol and polyol demulsifiers is found in U.S. Pat. No. 4,234,435 beginning at Col. 29, line 51 to Col. 32, line 34, and this disclosure is hereby incorporated by reference. A non-limiting example of a useful polyglycol demulsifier is a commercially available polyoxyalkylene glycol in aromatic hydrocarbons which is available under the trade designation Tolad 370 from the Tretolite Division of Petrolite. Other examples of commercially available polyoxyalkylene demulsifiers include the Pluronic and Tetronic polyols from Wyandotte Chemicals Co.; Polyglycols from Dow Chemical Co.; the Ethomeen, Duomeen, Ethoduomeen, and Ethomids, polyalkoxylated amines from Akzo Chemical, Inc., Chicago, Ill.; and the Tergitols and Ucons available from Union Carbide Corporation.

The supplemental polyglycol demulsifiers may be included in the lubricating compositions of the present invention in amounts of from about 0.001 to about 1% by weight. More generally, from about 0.01 to about 0.5% by weight.

In addition to the above components, the lubricant compositions of the present invention also may contain other additives including, for example, fluidity modifiers, auxiliary detergents and dispersants of the ash-producing type, corrosion- and oxidation-inhibiting agents, pour point depressing agents, extreme pressure agents, friction modifiers, color stabilizers, viscosity modifiers, anti-foam agents, etc. One or more of each of these additives may be included in the lubricating compositions of the present invention within the range of from about 0,001 to about 15%, and preferably in amounts of 0.01 to about 10%.

Auxiliary extreme pressure agents and corrosion-and oxidation-inhibiting agents which may be included in the lubricants and functional fluids of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Many of the above-mentioned auxiliary extreme pressure agents and corrosion-oxidation inhibitors also serve as antiwear agents. Zinc dialkylphosphorodithioates are a well known example.

Friction-modifying agents which may be useful in the lubricating compositions of the present invention include: alkyl or alkenyl phosphates or phosphites in which the alkyl or alkenyl group contains from about 10 to about 40 carbon atoms, and metal salts thereof, especially zinc salts; $C_{12-20}$ fatty acid amides; $C_{10-20}$ alkyl amines, especially tallow amines and ethoxylated derivatives thereof; salts of the amines with acids such as boric acid or phosphoric acid which have been partially esterified as noted above; etc.

Sulfur-containing compositions prepared by the sulfurization of olefins are particularly useful in improving the anti-wear, extreme pressure and antioxidant properties of the lubricating oil compositions. When included in the oil compositions of this invention, the oil composition typically will contain from about 0.01 to about 2% of the sulfurized olefin. The olefins may be any aliphatic, arylaliphatic or alicyclic olefinic hydrocarbon containing from about 3 to about 30 carbon atoms. The olefinic hydrocarbons contain at least one olefinic double bond, which is defined as a non-aromatic double bond; that is, one connecting two aliphatic carbon atoms. In its broadest sense, the olefinic hydrocarbon may be defined by the formula $$R^7R^8C{=}CR^9R^{10}$$

wherein each of $R^7$, $R^8$, $R^9$ and $R^{10}$ is hydrogen or a hydrocarbon (especially alkyl or alkenyl) radical. Any two of $R^7$, $R^8$, $R^9$, $R^{10}$ may also together form an alkylene or substituted alkylene group; i.e., the olefinic compound may be alicyclic.

Monoolefinic and diolefinic compounds, particularly the former, are preferred, and especially terminal monoolefinic hydrocarbons; that is, those compounds in which $R^9$ and $R^{10}$ are hydrogen and $R^7$ and $R^8$ are alkyl (that is, the olefin is aliphatic). Olefinic compounds having about 3–20 carbon atoms are particularly desirable.

Propylene, isobutene and their dimers, trimers and tetramers, and mixtures thereof are especially preferred olefinic compounds. Of these compounds, isobutene and diisobutene are particularly desirable because of their availability and the particularly high sulfur-containing compositions which can be prepared therefrom.

The sulfurizing reagent may be, for example, sulfur, a sulfur halide such as sulfur monochloride or sulfur dichloride, a mixture of hydrogen sulfide and sulfur or sulfur dioxide, or the like. Sulfur-hydrogen sulfide mixtures are often preferred and are frequently referred to hereinafter; however, it will be understood that other sulfurization agents may, when appropriate, be substituted therefor.

The amounts of sulfur and hydrogen sulfide per mole of olefinic compound are, respectively, usually about 0.3–3.0 gram-atoms and about 0.1–1.5 moles. The preferred ranges are about 0.5–2.0 gram-atoms and about 0.5–1.25 moles respectively, and the most desirable ranges are about 1.2–1.8 gram-atoms and about 0.4–0.8 mole respectively.

The temperature range in which the sulfurization reaction is carried out is generally about 50°–350° C. The preferred range is about 100°–200° C., with about 125°–180° C. being especially suitable. The reaction is often preferably conducted under superatmospheric pressure; this may be and usually is autogenous pressure (i.e., the pressure which naturally develops during the course of the reaction) but may also be externally applied pressure. The exact pressure developed during the reaction is dependent upon such factors as the design and operation of the system, the reaction temperature and the vapor pressure of the reactants and products and it may vary during the course of the reaction.

It is frequently advantageous to incorporate materials useful as sulfurization catalysts in the reaction mixture. These materials may be acidic, basic or neutral, but are preferably basic materials, especially nitrogen bases including ammonia and amines, most often alkylamines. The amount of catalyst used is generally about 0.01–2.0% of the weight of the olefinic compound. In the case of the preferred ammonia and amine catalysts, about 0.0005–0.5 mole per mole of olefin is preferred, and about 0.001–0.1 mole is especially desirable.

Following the preparation of the sulfurized mixture, it is preferred to remove substantially all low boiling materials, typically by venting the reaction vessel or by distillation at atmospheric pressure, vacuum distillation or stripping, or passage of an inert gas such as nitrogen through the mixture at a suitable temperature and pressure.

A further optional step in the preparation of the sulfurized olefins is the treatment of the sulfurized product, obtained as described hereinabove, to reduce active sulfur. An illustrative method is treatment with an alkali metal sulfide. Other optional treatments may be employed to remove insoluble by-products and improve such qualities as the odor, color and staining characteristics of the sulfurized compositions.

U.S. Pat. No. 4,119,549 is incorporated by reference herein for its disclosure of suitable sulfurized olefins useful in the lubricating oils of the present invention. Several specific sulfurized compositions are described in the working examples thereof. The following examples illustrate the preparation of two such compositions.

EXAMPLE S-1

Sulfur (629 parts, 19.6 moles) is charged to a jacketed high-pressure reactor which is fitted with agitator and internal cooling coils. Refrigerated brine is circulated through the coils to cool the reactor prior to the introduction of the gaseous reactants. After sealing the reactor, evacuating to about 6 torr and cooling, 1100 parts (9.6 moles) of isobutene, 334 parts (9.8 moles) of hydrogen sulfide and 7 parts of n-butylamine are charged to the reactor. The reactor is heated, using steam in the external jacket, to a temperature of about 171° C. over about 1.5 hours. A maximum pressure of 720 psig is reached at about 138° C. during this heat-up. Prior to reaching the peak reaction temperature, the pressure starts to decrease and continues to decrease steadily as the gaseous reactants are consumed. After about 4.75 hours at about 171° C., the unreacted hydrogen sulfide and isobutene are vented to a recovery system. After the pressure in the reactor has decreased to atmospheric, the sulfurized product is recovered as a liquid.

EXAMPLE S-2

Following substantially the procedure of Example S-1, 773 parts of diisobutene are reacted with 428.6 parts of sulfur and 143.6 parts of hydrogen sulfide in the presence of 2.6 parts of n-butylamine, under autogenous pressure at a temperature of about 150°–155° C. Volatile materials are removed and the sulfurized product is recovered as a liquid.

Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

Anti-foam agents are used to reduce or prevent the formation of stable foam. Typical anti-foam agents include silicones or organic polymers. Additional anti-foam compositions are described in "Foam Control Agents" by Henry T. Kerner (Noyes Data Corporation, 1976), pages 125–162.

The lubricating compositions of the present invention may be prepared by dissolving or suspending the various components directly in a base oil along with any other additives which may be used. More often, one or more of the chemical components used in the present invention are diluted with a substantially inert, normally liquid organic diluent/solvent such as mineral oil, to form an additive concentrate. These concentrates usually contain from about 20 to about 90% by weight of the chemical additives, and from about 10 to about 80% by weight of diluent. For example, concentrates in accordance with the present invention may contain from about 0.1 and more generally from about 10% to about 50% by weight of the ashless dispersant (B) and from about 0.01 to about 15% by weight of demulsifier (C). The concentrates also may contain any of the other additives described above including, for example, from 1% to about 60% by weight of a sulfurized olefin.

The following examples illustrate concentrates of the present invention.

| | Parts/Wt. |
|---|---|
| Concentrate I | |
| Product of Ex. B-20 | 45 |
| 1-(5-hydroxypentyl)-2-dodecylimidazoline | 10 |
| Mineral Oil | 45 |
| Concentrate II | |
| Product of Ex. B-26 | 50 |
| 1-hydroxyethyl-2-(1-heptadecenyl)imidazoline | 5 |
| Product of Ex. S-1 | 30 |
| Mineral Oil | 15 |

Typical lubricating oil compositions according to the present invention are exemplified in the following lubricating oil examples.

| | Parts/Wt. |
|---|---|
| Lubricant A | |
| Base Oil | 98 |
| Product of Ex. B-25 | 1.6 |
| 2-dodecyloxazoline | 0.5 |
| Lubricant B | |
| Base Oil | 96.75 |
| Product of Ex. B-25 | 3.00 |
| 1-(4-hydroxybutyl)-2-(1-heptadecenyl)-imidazoline | 0.25 |
| Lubricant C | |
| Base Oil | 95.20 |
| Product of Ex. B-25 | 1.5 |
| 1-(2-hydroxyethyl)imidazoline | 0.2 |
| Oleylamide | 1.0 |
| Sulfurized Isobutylene | 2.1 |

| | Lubricants | | |
|---|---|---|---|
| | D | E | F |
| 100 Neutral Mineral Oil | remainder | | |
| Product of Ex. B-25 | 0.44 | 0.44 | 0.8 |

-continued

| | | | |
|---|---|---|---|
| 1-(2-hydroxyethyl)-2-1-heptadecenyl)-imidazoline | 0.2 | 0.2 | 0.02 |
| Tolad 370 | — | 0.005 | — |
| Amine neutralized phosphate ester of hydroxyalkyl dialkylphosphorodithioate | 0.58 | 0.60 | 0.60 |
| Monoisopropyl amine | 0.014 | 0.02 | 0.02 |
| Oleyl amine | 0.044 | 0.04 | 0.04 |
| Sulfurized isobutylene | 1.88 | 1.70 | 1.75 |
| Reaction product of alkylphenol, formaldehyde and dimercaptothiadiazole | 0.054 | 0.06 | 0.06 |
| Acrylate terpolymer derived from 2-ethylhexyl acrylate, ethyl acrylate and vinyl acetate | 0.026 | 0.03 | 0.03 |

The lubricating compositions of the present invention include crankcase lubricating oils for spark-ignited and compression-ignited internal combustion engines, including automobile and truck engines, two-cycle engines, aviation piston engines, marine and railroad diesel engines, etc. They also can be used in gas engines, stationary power engines and turbines. Compositions prepared in accordance with the present invention also are useful in automatic transmission fluids, transaxle lubricants, gear lubricants, metal-working lubricants, hydraulic fluids, etc. The lubricants are particularly useful as gear lubricants in automotive as well as industrial applications, and particularly where the lubricating compositions are likely to be contaminated with water either during storage, handling and/or use. The lubricant compositions of the invention are particularly useful as multipurpose gear oil additives for both automotive and industrial applications. The gear lubricants are thermally stable and provide component cleanliness at elevated temperatures. Gear oil formulations prepared using the lubricant compositions of this invention are capable of meeting the automotive API GL-5 and the industrial USS224 requirements.

The effectiveness of the demulsifiers (C) utilized in the lubricating compositions of the present invention is demonstrated when the lubricating oil formulations are subjected to the Demulsibility Test as described in ASTM D-2711. This test provides a method to measure an oil's ability to separate water, and the test is most effective when the test lubricants are medium to high viscosity products such as gear oils, high viscosity bearing oils or circulation oils.

The test procedure for gear oils uses 90 ml. of water and 360 ml. of oil with stirring at 2500 rpm for 5 minutes in a blender. The mixture then is transferred to a graduated cylinder, and after a 5-hour settling period at 82.2° C., the amount of water separated from the emulsion is determined. Oils showing greater than 80 ml. separation in this test are considered to have excellent demulsibility characteristics. The results of this demulsibility test conducted on lubricant Example D and two control examples not containing the demulsifier (C) of the invention are summarized in the following Table I. Control-1 is a lubricating composition similar to Lubricant D except that the imidazoline demulsifier is omitted. Control-2 is a lubricating composition similar to Lubricant D except that the imidazoline demulsifier has been replaced by 0.2% by weight of Tolad 370.

TABLE I

| Oil Sample | ASTM D-2711 Demulsibility* Free Water (ml) | Water in oil (%) | Emulsion (ml) |
|---|---|---|---|
| Control-1 | 0 | 0 | 100 |
| Control-2 | 67 | 20 | 0.6 |
| Lubricant D | 83 | 1.1 | 0.2 |

*Average of two runs.

As can be seen from the results of the Demulsibility Test, the lubricant compositions of the present invention exhibit improved demulsibility when compared to control lubricants containing no demulsifier and Control-2 which contained a known polyglycol demulsifier.

The anti-wear properties of the lubricating compositions of the present invention is evaluated utilizing the Shell Four-Ball Wear Test. In this test, four steel balls are arranged in a tetrahedron, the top ball was made to rotate against the three bottom balls, and the points of contact are lubricated by the test lubricant. During the test, scars are formed on the surfaces of the three stationary balls. The diameter of the scars depend upon the load, speed, duration of run and type of lubricant. In this test, (ASTM D-2266), the fourth ball is rotated at 1800 rpm for one hour under a load of 20 Kg. The results of the wear test conducted with Lubricant D and control lubricants identified above as Control-1 and Control-2 are summarized in the following Table II. As can be seen from the results, the lubricant compositions of the present invention exhibits improved anti-wear properties.

TABLE II

| Oil Sample | Four Ball Wear Scar Diameter (mm)* |
|---|---|
| Control-1 | 0.42 |
| Control-2 | 0.44 |
| Lubricant D | 0.30 |

*Average of two runs.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A lubricating composition comprising a mixture of
(A) a major amount of an oil of lubricating viscosity,
(B) a dispersant effective amount of at least one nitrogen- and boron-containing composition prepared by reacting
(B-1) a boron compound selected from the group consisting of boron trioxide, boron anhydrides, boron halides, boron acids, boron amides, esters of boric acid and mixtures thereof with
(B-2) at least one acylated nitrogen intermediate prepared by the reaction of
(B-2-a) at least one substituted succinic acylating agent with
(B-2-b) at least about one-half equivalent, per equivalent of acylating agent, of an amine characterized by the presence within its structure of at least one >NH group wherein said substituted succinic acylating agent consists of substituent groups and succinic groups, and the substituent groups are derived from polyalkene characterized as having an $\overline{M}n$ value of at least about 700, and
(C) a minor, effective amount of at least one demulsifier characterized by the formula

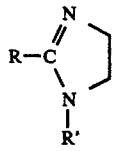

wherein R is an alkyl or alkenyl group containing from about 5 to about 30 carbon atoms, and R' is hydrogen or a hydrocarbyl group containing from 1 to about 8 carbon atoms.

2. The lubricating composition of claim 1 wherein the boron compound (B-1) is boric acid.

3. The lubricating composition of claim 1 wherein the boron compound (B-1) and acylated nitrogen intermediate (B-2) are reacted in amounts to provide up to about 10 atomic proportions of boron for each atomic proportion of nitrogen in said acylated nitrogen intermediate.

4. The lubricating composition of claim 1 wherein the substituent group in the substituted succinic acylating agent is derived from a polyalkene having an average Mn value within the range of from about 700 to about 5000.

5. The lubricating composition of claim 1 wherein the polyalkene is a polybutene in which at least about 50% of the total units derived from butene are derived from isobutene.

6. The lubricating composition of claim 1 wherein the substituent group of the acylated nitrogen intermediate is derived from a polyalkene having a number average molecular weight in the range of from about 700 to about 1500.

7. The lubricating composition of claim 1 wherein the amine (B-2-b) is an aliphatic, cycloaliphatic or aromatic polyamine.

8. The lubricating composition of claim 1 wherein the amine (B-2-b) is a hydroxy-substituted monoamine, polyamine, or mixtures thereof.

9. The lubricating composition of claim 1 wherein the amine (B-2-b) is characterized by the general formula

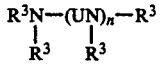

wherein n is an integer of from 1 to about 10, each $R^3$ is independently a hydrogen atom, a hydrocarbyl group or a hydroxy-substituted or amino-substituted hydrocarbyl group having up to about 30 carbon atoms, or two $R^3$ groups on different nitrogen atoms can be joined together to form a U group with the proviso that at least one $R^3$ group is a hydrogen atom, and U is an alkylene group of about 2 to about 10 carbon atoms.

10. The lubricating composition of claim 1 wherein the amine (B-2-b) is a polyalkylene polyamine.

11. The lubricating composition of claim 1 wherein R' in demulsifier (C) is hydrogen.

12. The lubricating composition of claim 1 wherein R in demulsifier (C) is an alkenyl group containing from 9 to about 25 carbon atoms.

13. The lubricating composition of claim 1 wherein R′ in demulsifier (C) is a hydrocarbyl group containing at least one >NH or OH group.

14. The lubricating composition of claim 1 wherein the demulsifier (C) is characterized by the formula

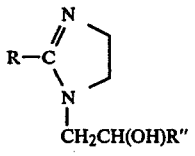

wherein R is a hydrocarbyl group containing about 5 to about 30 carbon atoms and R″ is H or a hydrocarbyl group containing from 1 to about 6 carbon atoms.

15. The lubricating composition of claim 1 containing from about 0.1 to about 10% by weight of the nitrogen- and boron-containing composition (B) and from about 0.01 to about 1% by weight of the demulsifier (C).

16. The lubricating composition of claim 1 also containing (D) from about 0.01 to about 1% by weight of at least one polyglycol demulsifier.

17. A lubricating composition comprising a mixture of (A) a major amount of an oil of lubricating viscosity, (B) from about 0.1 to about 5% by weight of at least one nitrogen- and boron-containing composition prepared by reacting (B-1) a boron compound selected from the group consisting of boron trioxide, boron anhydrides, boron halides, boron acids, boron amides, esters of boric acid, and mixtures thereof with (B-2) at least one acylated nitrogen intermediate prepared by reacting (B-2-a) at least one substituted succinic acylating agent with (B-2-b) from about one-half equivalent up to about 2 moles, per equivalent of acylating agent, of at least one polyamine compound characterized by the presence within its structure of at least one >NH group, wherein said substituted succinic acylating agent consists of substituent groups and succinic groups, and the substituent groups are derived from polyalkenes characterized as having an $\overline{M}n$ value of from about 700 to about 5000, and (C) from about 0.01 to about 0.5% by weight of at least one demulsifier characterized by the formula

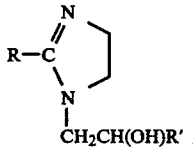

wherein R is an alkyl or alkenyl group containing from about 9 to about 25 carbon atoms, and R′ is hydrogen or an alkyl group containing from 1 to about 6 carbon atoms.

18. The lubricating composition of claim 17 wherein the amounts of boron compound (B-1) and acylated nitrogen intermediate (B-2) reacted are sufficient to provide from about 0.1 atomic proportion of boron for each mole of said acylated nitrogen intermediate to about 10 atomic proportions of boron for each atomic proportion of nitrogen in said intermediate.

19. The lubricating composition of claim 17 wherein the boron compound is boric acid.

20. The lubricating composition of claim 17 wherein the value of Mn in (B-2-a) is from about 700 to about 1500.

21. The lubricating composition of claim 17 wherein the substituent groups in (B-2-a) are derived from a polybutene in which at least about 50% of the total units derived from butene are derived from isobutene.

22. The lubricating composition of claim 17 wherein the polyamine (B-2-b) is characterized by the formula

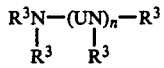

wherein n is an integer of from 1 to about 10, each $R^3$ is independently a hydrogen atom, a hydrocarbyl group or a hydroxy-substituted or amino-substituted hydrocarbyl group having up to about 30 carbon atoms, or two $R^3$ groups on different nitrogen atoms can be joined together to form a U group with the proviso that at least one $R^3$ group is a hydrogen atom, and U is an alkylene group of about 2 to about 10 carbon atoms.

23. The lubricating composition of claim 17 wherein the polyamine (B-2-b) is a polyalkylene polyamine.

24. The lubricating composition of claim 17 wherein R in demulsifier (C) is an alkenyl group containing from 9 to about 25 carbon atoms.

25. The lubricating composition of claim 17 wherein R′ in demulsifier (C) is hydrogen.

26. The lubricating composition of claim 17 also containing from about 0.02 to about 0.5% by weight of at least one polyglycol demulsifier.

27. A lubricating composition comprising the mixture of (A) a major amount of an oil of lubricating viscosity, (B) from about 0.1 to about 5% by weight of at least one nitrogen- and boron-containing composition prepared by reacting (B-1) boric acid with (B-2) at least one acylated nitrogen intermediate prepared by the reaction of (B-2-a) at least one substituted succinic acylating agent with from about one-half equivalent up to about two moles per equivalent of acylating agent, of (B-2-b) at least one polyamine characterized by the presence within its structure of at least one >NH group, and wherein said substituted succinic acylating agent consists of substituent groups and succinic groups, the substituent groups are derived from a polyalkene having an $\overline{M}n$ value of from about 700 to about 5000, and the amounts of (B-1) and (B-2) are sufficient to provide from about 0.1 atomic proportion of boron for each mole of said acylated nitrogen intermediate up to about 10 atomic proportions of boron for each atomic proportion of nitrogen of said acylated nitrogen intermediate, and (C) from about 0.02 to about 0.5% by weight of at least one demulsifier selected from 1-(2-hydroxyethyl)-2-alkenyl imidazolines wherein the alkenyl group contains from about 9 to about 25 carbon atoms.

28. The lubricating composition of claim 27 wherein the polyamine (B-2-b) is a polyalkylene polyamine.

29. The lubricating composition of claim 27 wherein the value of $\overline{M}n$ in (B-2-a) is from about 700 to about 1500.

30. The lubricating composition of claim 27 wherein the polyalkene is a polybutene in which at least about 50% of the total units derived from butenes are derived from isobutene.

31. The lubricating composition of claim 27 wherein the acylated nitrogen intermediate is prepared by the reaction of about one equivalent of the substituted succinic acylating agent (B-2-a) with about one equivalent of the polyamine (B-2-b).

32. The lubricating composition of claim 27 wherein the alkenyl group in demulsifier (C) is heptadecenyl-1.

33. The lubricating composition of claim 27 also containing (D) from about 0.02 to about 0.5% by weight of at least one polyglycol demulsifier.

34. A concentrate for formulating lubricating oil compositions comprising (A) from about 20 to about 90% by weight of a normally liquid, substantially inert organic diluent/solvent, (B) from about 0.1 to about 50% by weight of at least one nitrogen- and boron-containing composition prepared by reacting (B-1) a boron compound selected from the group consisting of boron trioxide, boron anhydrides, boron halides, boron acids, boron amides, esters of boric acid and mixtures thereof with (B-2) at least one acylated nitrogen intermediate prepared by the reaction of (B-2-a) at least one substituted succinic acylating agent with (B-2-b) at least about one-half equivalent, per equivalent of acylating agent, of an amine characterized by the presence within its structure of at least one >NH group wherein said substituted succinic acylating agent consists of substituent groups and succinic groups, and the substituent groups are derived from polyalkene characterized as having an $\overline{M}n$ value of at least about 700, and (C) from about 0.01 to about 15% by weight of at least one demulsifier characterized by the formula

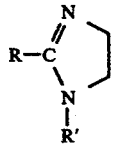

wherein R is an alkyl or alkenyl group containing from about 5 to about 30 carbon atoms, and R' is hydrogen or a hydrocarbyl group containing from 1 to about 8 carbon atoms.

35. The concentrate of claim 34 also containing from about 0.01 to about 15% by weight of at least one polyglycol demulsifier.

36. A thermally stable automotive or industrial gear lubricating composition comprising a mixture of (A) a major amount of an oil of lubricating viscosity, (B) a dispersant effective amount of at least one ashless dispersant, (C) a minor, effective amount of at least one demulsifier characterized by the formula

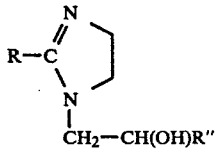

wherein R is a hydrocarbyl group containing about 5 to about 30 carbon atoms and R'' is H or a hydrocarbyl group containing from 1 to about 6 carbon atoms, and (E) an extreme pressure effective amount of at least one member selected from the group consisting of chlorinated aliphatic hydrocarbons, organic sulfides, organic polysulfides and phosphorus esters.

37. The composition of claim 36 wherein the ashless dispersant (B) is a carboxylic dispersant comprising reaction product of at least one carboxylic acylating agent with a reactant selected from the group consisting of (a) amines characterized by the presence within their structure of at lest one >NH group, (b) alcohols or phenols, (c) reactive metal or reactive metal compounds, and (d) mixtures of two or more of (a) through (c).

38. The composition of claim 37 wherein the carboxylic dispersant (B) comprises a nitrogen and boron containing reaction product of a carboxylic acylating agent with (a) or (b), or mixtures thereof which is post-treated with at least one reagent selected from the group consisting of boron trioxides, boron anhydrides, boron halides, boron acids, boron amides, esters of boric acid and mixtures thereof.

39. The composition of claim 36 wherein the ashless dispersant is a borated alkenyl succinimide dispersant wherein the alkenyl group is derived from a polyalkene having an $\overline{M}n$ value of from about 700 to about 5000.

40. The lubricating composition of claim 38 containing from about 0.1 to about 10% by weight of the nitrogen- and boron-containing composition (B) and from about 0.01 to about 1% by weight of the demulsifier (C).

41. The lubricating composition of claim 36 also containing (D) from about 0.01 to about 1% by weight of at least one polyglycol demulsifier.

42. The gear lubricating composition of claim 36 wherein (E) the organic sulfides and polysulfides are prepared by the sulfurization of olefins.

43. The composition of claim 42 comprising from about 0.01 to about 2% of the organic sulfides and polysulfides.

44. The composition of claim 42 wherein the olefin contains from about 3 to about 20 carbon atoms.

45. The composition of claim 42 wherein the sulfurization is effected employing a sulfurizing agent comprising sulfur, a sulfur halide, a mixture of hydrogen sulfide and sulfur or sulfur dioxide.

46. The composition of claim 42 wherein (E) is a sulfurized olefin prepared by reacting olefins containing from about 3 to about 20 carbon atoms with a sulfur-hydrogen sulfide mixture in the presence of a catalyst.

47. The lubricant of claim 46 wherein the olefin is selected from propylene, isobutene, and dimers, trimers and tetramers thereof, and the catalyst is a basic catalyst.

48. The lubricant of claim 47 wherein the amounts of sulfur and hydrogen sulfide per mole of olefin are, respectively, 0.3–3.0 gram-atoms and about 0.1–1.5 moles.

* * * * *